US009234370B2

(12) United States Patent
Dolev et al.

(10) Patent No.: US 9,234,370 B2
(45) Date of Patent: Jan. 12, 2016

(54) KEY BLANK, KEY AND CYLINDER LOCK WITH REDUCED COSTS

(76) Inventors: Moshe Dolev, Raanana (IL); Eyal Artsiely, Arvot Hayarden (IL)

( * ) Notice: Subject to any disclaimer, the term of this patent is extended or adjusted under 35 U.S.C. 154(b) by 0 days.

(21) Appl. No.: 13/206,645

(22) Filed: Aug. 10, 2011

(65) Prior Publication Data

US 2012/0210758 A1 Aug. 23, 2012

Related U.S. Application Data

(63) Continuation of application No. 13/031,264, filed on Feb. 21, 2011, now abandoned.

(51) Int. Cl.

| | |
|---|---|
| ***E05B 27/00*** | (2006.01) |
| ***E05B 29/00*** | (2006.01) |
| ***E05B 9/04*** | (2006.01) |
| ***E05B 19/04*** | (2006.01) |
| *E05B 63/00* | (2006.01) |
| *E05B 9/10* | (2006.01) |
| *E05B 15/02* | (2006.01) |
| *E05B 17/04* | (2006.01) |

(52) U.S. Cl.

CPC ..... *E05B 9/042* (2013.01); *E05B 19/04* (2013.01); *E05B 29/0013* (2013.01); *E05B 9/10* (2013.01); *E05B 15/02* (2013.01); *E05B 17/04* (2013.01); *E05B 27/0021* (2013.01); *E05B 27/0082* (2013.01); *E05B 29/0066* (2013.01); *E05B 63/006* (2013.01); *E05B 2009/046* (2013.01); *Y10T 70/7588* (2015.04); *Y10T 70/7621* (2015.04); *Y10T 70/7819* (2015.04)

(58) Field of Classification Search

CPC ..... E05B 9/042; E05B 19/04; E05B 29/0013; E05B 9/10; E05B 17/04; E05B 63/006; E05B 27/0082; E05B 2009/046; E05B 27/0021; E05B 15/02; E05B 29/0066; Y10T 70/7588; Y10T 70/7819; Y10T 70/7621

USPC ..... 70/373, 372, 448, 449, 365, 366, 374, 70/493, 492, 301, 495, 496, 419, 421, 70/DIG. 44, DIG. 54, DIG. 55

See application file for complete search history.

(56) References Cited

U.S. PATENT DOCUMENTS

| | | | | | |
|---|---|---|---|---|---|
| 1,592,091 | A | * | 7/1926 | Fairchild | 70/252 |
| 2,023,847 | A | * | 12/1935 | Liss | 70/494 |
| 2,182,588 | A | * | 12/1939 | Jacobi | 70/366 |
| 2,563,215 | A | * | 8/1951 | Crumb | 70/366 |
| 3,002,268 | A | * | 10/1961 | Spain | 29/436 |
| 3,293,892 | A | * | 12/1966 | Falk | 70/493 |
| 3,367,155 | A | * | 2/1968 | Kobrehel | 70/366 |
| 3,585,826 | A | * | 6/1971 | Mercurio et al. | 70/366 |

(Continued)

FOREIGN PATENT DOCUMENTS

| | | |
|---|---|---|
| DE | 816657 | 10/1951 |
| DE | 1143735 | 2/1963 |
| FR | 2232947 | 1/1975 |

OTHER PUBLICATIONS

PCT Written Opinion PCT/US2012/025770, Jan. 23, 2013.

*Primary Examiner* — David E Sosnowski

(74) *Attorney, Agent, or Firm* — Dekel Patent Ltd.; David Klein

(57) ABSTRACT

An article including a key comprising a key head that slides along a key shaft, said key head being affixable to said key shaft with a fastener.

3 Claims, 22 Drawing Sheets

(56) References Cited

U.S. PATENT DOCUMENTS

| | | | | | |
|---|---|---|---|---|---|
| 3,928,992 | A | | 12/1975 | Talbot | |
| 4,044,578 | A | * | 8/1977 | Guiraud | 70/366 |
| 4,472,953 | A | * | 9/1984 | Gater | 70/373 |
| 4,603,566 | A | * | 8/1986 | Kruehn et al. | 70/380 |
| 4,624,119 | A | * | 11/1986 | Newman et al. | 70/366 |
| 4,723,427 | A | * | 2/1988 | Oliver | 70/494 |
| 4,850,210 | A | * | 7/1989 | Adler et al. | 70/383 |
| 4,977,767 | A | | 12/1990 | Prunbauer | |
| 5,123,268 | A | | 6/1992 | Eizen | |
| 5,295,376 | A | * | 3/1994 | Myers | 70/369 |
| 6,170,307 | B1 | * | 1/2001 | Feder | 70/419 |
| 6,776,017 | B2 | * | 8/2004 | Herdman | 70/338 |
| 7,322,219 | B2 | * | 1/2008 | Armstrong et al. | 70/492 |
| 7,530,246 | B2 | * | 5/2009 | Yang | 70/492 |
| 7,694,542 | B2 | * | 4/2010 | Loughlin et al. | 70/366 |
| 7,712,342 | B2 | * | 5/2010 | Loughlin et al. | 70/366 |
| 8,033,150 | B2 | * | 10/2011 | Armstrong et al. | 70/492 |
| 2006/0032280 | A1 | * | 2/2006 | Edwards et al. | 70/495 |
| 2008/0105013 | A1 | * | 5/2008 | Agbay | 70/394 |
| 2008/0295548 | A1 | * | 12/2008 | Misner et al. | 70/21 |
| 2009/0277235 | A1 | * | 11/2009 | Huang et al. | 70/366 |
| 2010/0018267 | A1 | * | 1/2010 | Huang et al. | 70/449 |
| 2010/0031716 | A1 | * | 2/2010 | Teixeira | 70/373 |
| 2010/0326150 | A1 | * | 12/2010 | Chung | 70/491 |
| 2011/0011139 | A1 | * | 1/2011 | Marcelle et al. | 70/372 |
| 2012/0031156 | A1 | * | 2/2012 | Wheatland | 70/449 |
| 2012/0118032 | A1 | * | 5/2012 | Baumann | 70/373 |

* cited by examiner

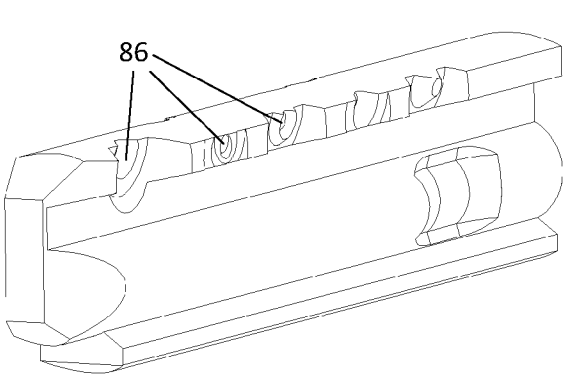
FIG. 40
FIG. 41
FIG. 42
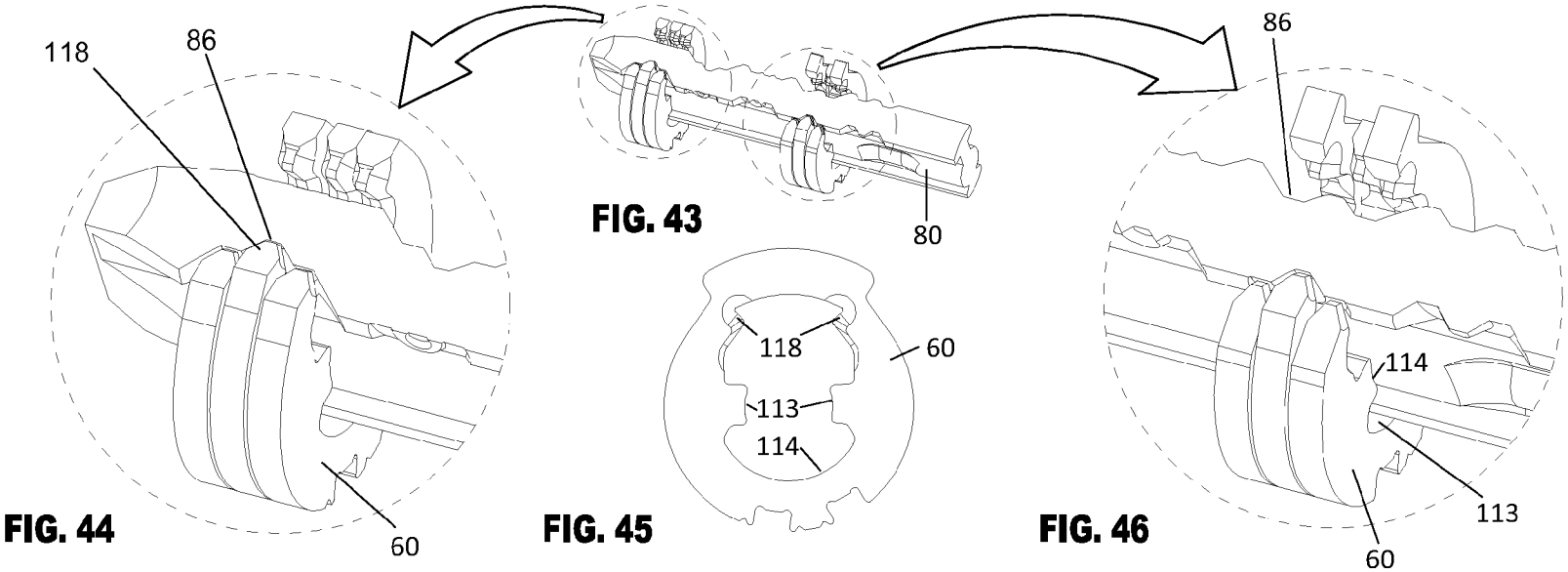
FIG. 43
FIG. 44
FIG. 45
FIG. 46

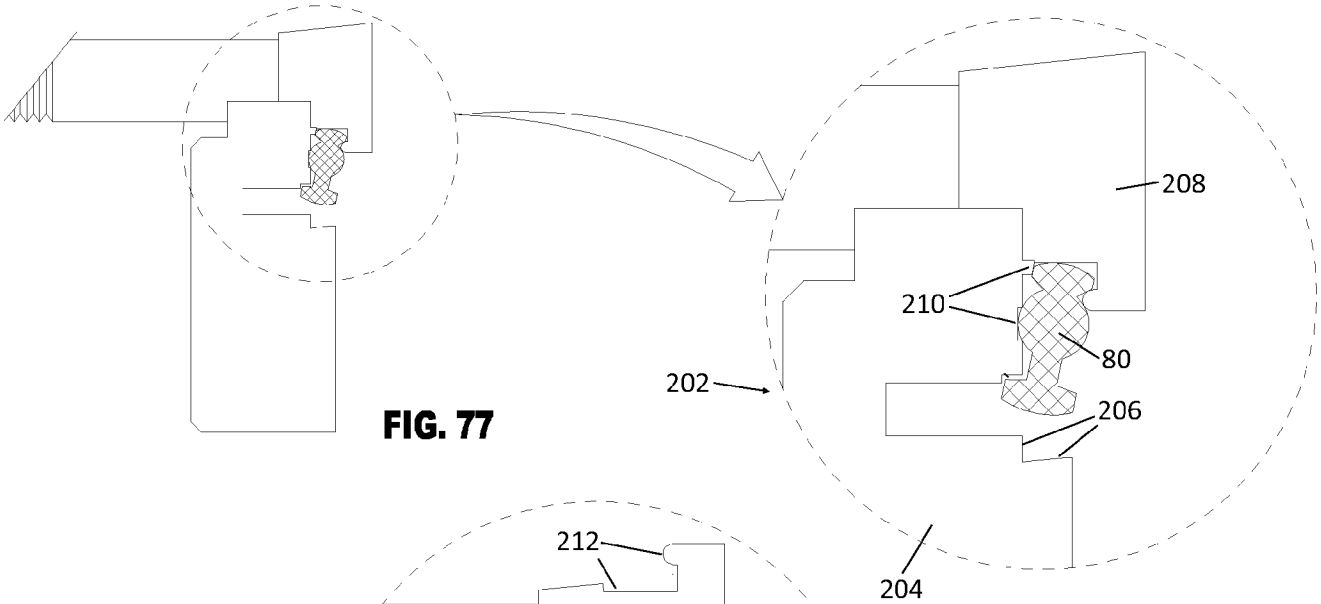
FIG. 78
FIG. 77
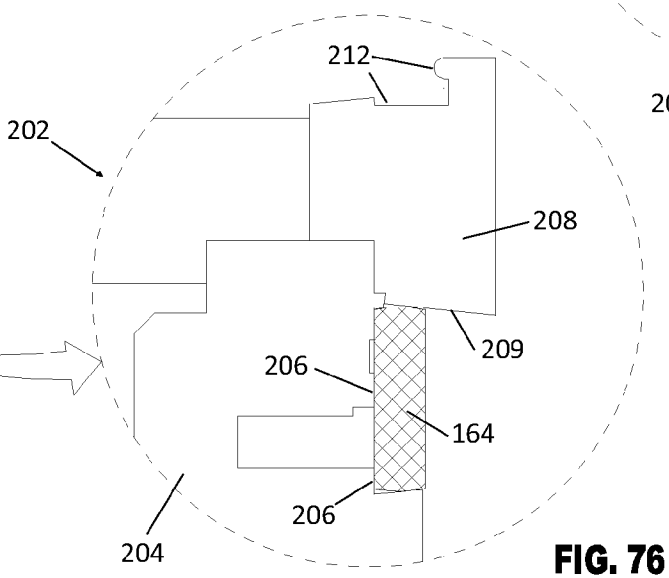
FIG. 76
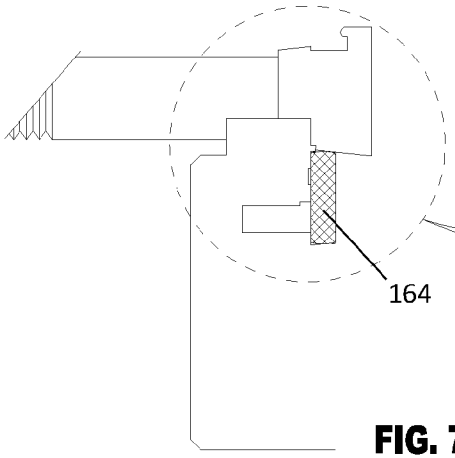
FIG. 75

KEY BLANK, KEY AND CYLINDER LOCK WITH REDUCED COSTS

CROSS REFERENCE TO OTHER APPLICATIONS

This application is a continuation of U.S. patent application Ser. No. 13/031,264, filed Feb. 21, 2011.

FIELD OF THE INVENTION

The present invention relates generally to cylinder locks, and particularly to a key blank, key and cylinder lock with reduced manufacturing and inventory costs.

BACKGROUND OF THE INVENTION

As is well known in the prior art, with reference to FIGS. 1 and 2, many cylinder locks include a plug 1 (also called a tumbler) arranged for rotation in a body 2 wherein the plug 1 and the body 2 are provided with a number of bores 3 and 4, respectively, in which plug pins and driver pins are disposed. The plug 1 is formed with a keyway for inserting therein a key 5. The driver pins are aligned with the plug pins, and the plug and driver pins have varying lengths that define a key cut combination. Upon insertion of a key with the correct key cut combination, the faces of the plug pins and driver pins that touch each other are aligned flush with the circumferential surface of the plug 1, referred to as the shear line, and the plug 1 may be rotated to actuate the lock. If the key cut combination is not correct, at least one of the driver and plug pins will cross over the shear line and prevent rotation of the plug 1, and thus prevent actuation of the lock.

FIGS. 1 and 2 show a European profile double cylinder lock. The cylinder lock actuates a common cam 6, which fits in a recess 7 formed in the body. The plug 1 may be formed with a longitudinal groove 8 for the key. Different holes 9 may be formed in the plug 1 and the body 2 for placing therein hardened, anti-drilling pins (not shown).

It is common to construct the plug 1 and body 2 from relatively soft metals, such as brass, although other metals are also used, such as different steel alloys. The plug and body are generally made by various machining manufacturing steps. It would be desirable to reduce manufacturing costs for making the cylinder lock.

The key is commonly made from metal, such as nickel silver or brass, but other metals are also used. The key is generally made in a coining or stamping process, whereas keyway profiles, key cuts and other features on the key are generally made by machining. Some cylinder locks come in different lengths, and the cylinder locksmith or installer has to select the proper cylinder length to match the dimensions of the door thickness. In addition, the inner side of the door often has a turning knob, that is, it is not operated by a key. These considerations increase inventory costs for different lengths of cylinder locks, and increase the difficulty of installation for the cylinder locksmith; sometimes the cylinder locksmith has to come twice to the customer—once to get the proper dimensions for installation and another time to actually install the cylinder lock.

SUMMARY OF THE INVENTION

The present invention seeks to provide a key blank, key and cylinder lock with reduced manufacturing and inventory costs, and with improved quality and security, as is described in detail further hereinbelow.

BRIEF DESCRIPTION OF THE DRAWINGS

The present invention will be understood and appreciated more fully from the following detailed description taken in conjunction with the drawings in which:

FIG. 40 is a simplified pictorial illustration of the key shaft;

FIG. 41 is a simplified sectional illustration of the key shaft, taken along section lines F-F in FIG. 40;

FIG. 42 is another simplified pictorial illustration of the key shaft, showing the lateral recess for changing the key into a turning knob;

FIG. 43 is a simplified pictorial illustration of the plug locking elements interfacing with key cuts formed on the key shaft;

FIG. 44 is an enlarged pictorial illustration of the plug locking elements interfacing with key cuts formed on the key shaft;

FIG. 45 is a simplified pictorial illustration of one of the plug locking elements;

FIG. 46 is another enlarged pictorial illustration of the plug locking elements interfacing with key cuts formed on the key shaft;

FIGS. 75 and 76 are pictorial and enlarged side-view illustrations, respectively, of the key holder of the present invention, with a conventional key affixed therein; and FIGS. 77 and 78 are pictorial and enlarged side-view illustrations, respectively, of the key holder of the present invention, with a key of the present invention affixed therein.

DETAILED DESCRIPTION OF EMBODIMENTS

It is noted that the terms "upper", "lower", "above", "below", "left" and "right", and the like, only refer to the sense of the drawings and do not limit the invention in any way.

It is further noted that ends of the plug are defined as follows: the "key insertion" end or the "proximal" end of the plug is the end facing the user for inserting the key into the keyway; the "distal" end is opposite to the key insertion end. The proximal and distal ends of the key correspond to the proximal and distal ends of the plug when the key is fully inserted into the plug.

Figures 1, 2:
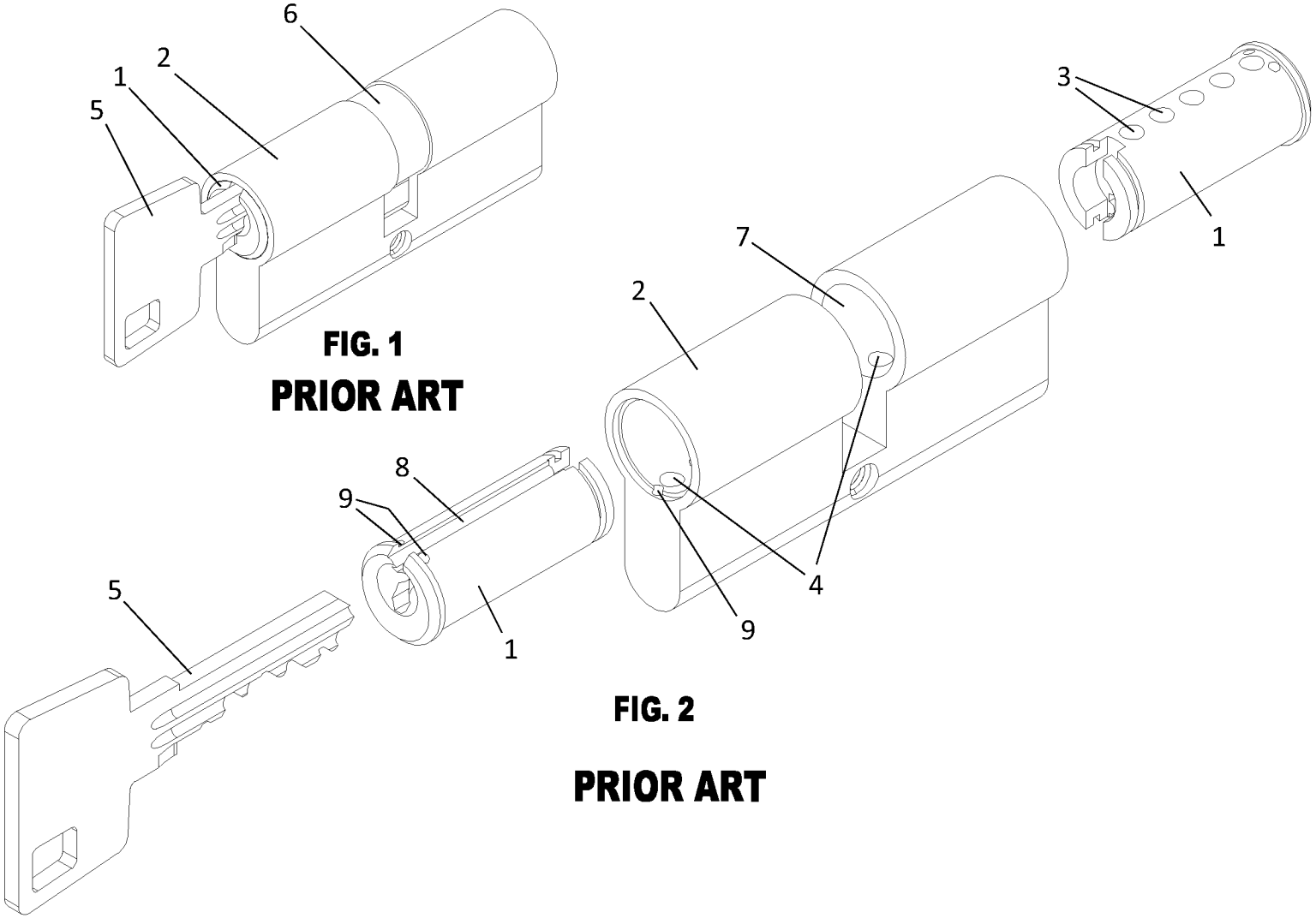
FIG. 1 PRIOR ART
FIG. 2 PRIOR ART
FIGS. 1 and 2 are simplified pictorial and exploded illustrations, respectively, of a prior art European profile double cylinder lock.
Figures 3, 4:
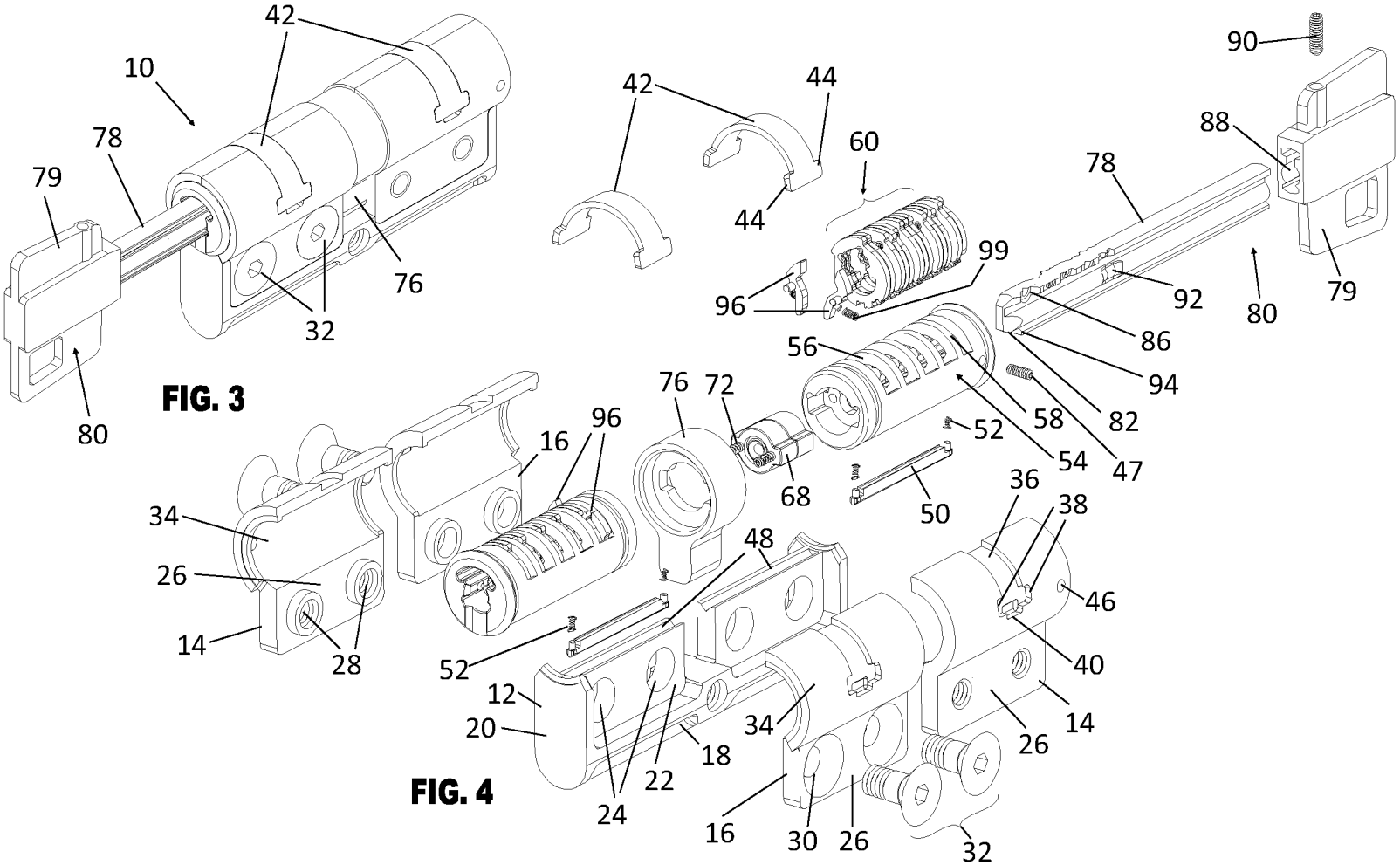
FIGS. 3 and 4 are simplified pictorial and exploded illustrations, respectively, of a cylinder lock, constructed and operative in accordance with an embodiment of the present invention, employing plug locking elements which are disc tumblers disposed in a plug.

Reference is now made to FIGS. 3 and 4, which illustrate a cylinder lock 10, constructed and operative in accordance with a non-limiting embodiment of the present invention. The major components of cylinder lock 10 may be made by MIM, e.g., using a steel alloy, e.g., a stainless steel alloy, such as but not limited to, 17-4PH, a precipitation hardening martensitic stainless steel. The illustrated embodiment is for a European profile double cylinder lock, but it is understood that the invention is not limited to such a cylinder lock.

In the illustrated embodiment, the body of cylinder lock 10 includes a chassis 12, and two half-shells 14 and 16 (which are the same for both sides of the double cylinder lock). The invention is not limited to just two shells and any number is also possible. Accordingly the general term "shell" is also used to refer to half-shell, third-shell, etc.

Chassis 12

Figure 8:
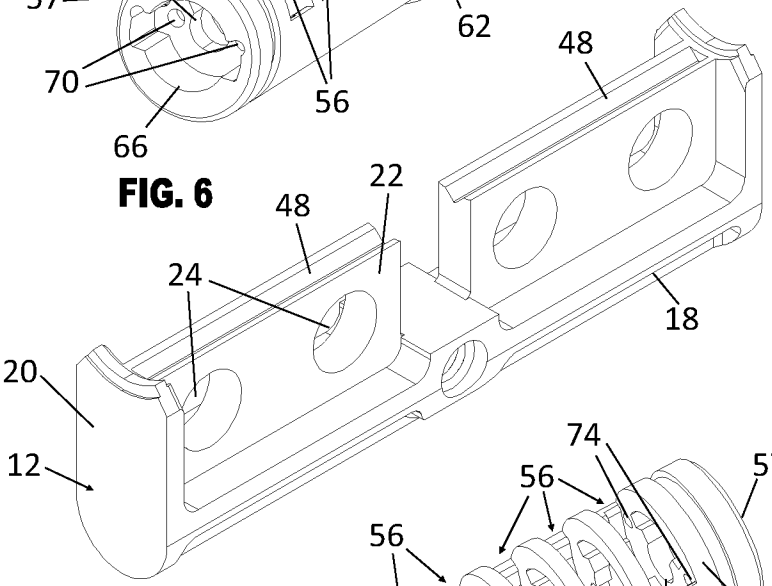
FIG. 8 is a simplified perspective illustration of a body chassis of the cylinder lock of FIG. 3.

Reference is additionally made to FIG. 8. Chassis 12 includes an elongate lower rib 18, from an end of which extends an upright end face 20. An inner abutment 22 extends from both lower rib 18 and end face 20. Abutment 22 is formed with mounting holes 24. In the final assembly, end face 20 forms the lower part of the standard European profile. Abutment 22 is formed with upper axial groove 48 for receiving therein a side bar 50, which is described further below with reference to FIGS. 14 and 15. Side bar 50 is shown in FIG. 4 with two biasing devices 52, such as two small coil springs.

Half-Shells 14 and 16

Reference is additionally made to FIGS. 5A, 5B, 7A and 7B. The half-shells 14 and 16 each include a lower side wall 26. One of the half-shells (14, in the illustration) is formed with tapped holes 28 and the other half-shell (16) is formed with through holes 30, which may be countersunk. Mechanical fasteners 32 (FIGS. 3 and 4), e.g., flat head screws, are used to secure the two half-shells 14 and 16 to one another. The half-shells 14 and 16 each include an upper half-cylindrical wall 34 extending from lower side wall 26. Half-cylindrical wall 34 is formed with a partially circumferential groove 36 which ends in two axial notches 38. A small recess 40 may be formed at the end of groove 36 between notches 38.

A resilient clasp 42 (FIGS. 3 and 4), formed with two outwardly extending tabs 44 at ends thereof, fits into groove 36 in the final assembly to affix the two half-shells 14 and 16 to one another. Tabs 44 fit into notches 38. A small tool (e.g., small flat blade screwdriver, not shown) can be inserted in recess 40 to dislodge clasp 42 from groove 36 for disassembly, if needed. In the final assembly, the pair of half-cylindrical walls 34 form the upper part of the standard European profile cylinder lock. An access hole 46 may be formed at an end of one or both of the half-cylindrical walls 34 for inserting therethrough a fastener (e.g., set screw) 47 for changing the key into a turn knob, as will be explained further below. A trap groove 49 (FIGS. 5B and 7B) may be formed on the inner side of the half-cylindrical walls 34 for receiving therein movable security catches 96 described further below with reference to FIG. 28.

It is noted that mechanical fasteners 32 and clasp 42 are just one example of fasteners for fastening the half-shells 14 and 16 together, and other fasteners can be used, such as but not limited to, circlips, retaining rings, snap rings, rivets and many others. It is noted that clasps 42 are optional and the lock halves may be fastened sufficiently without them.

It is noted that the cylinder lock body can be constructed of two half-shells without a chassis, by reshaping the two half-shells to include the lower rib and the end face, for example. It is also noted that the parts for the inner side and outer side of the cylinder lock are preferably identical to reduce manufacturing and inventory costs.

Plug 54

Figure 6:
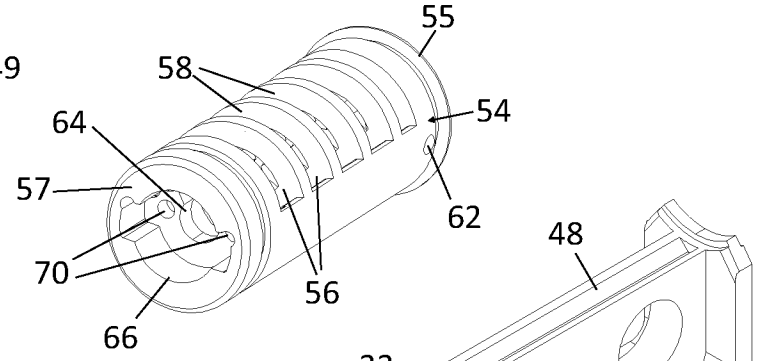
FIG. 6 is a simplified perspective illustration of the plug of the cylinder lock of FIG. 3.
Figure 9:
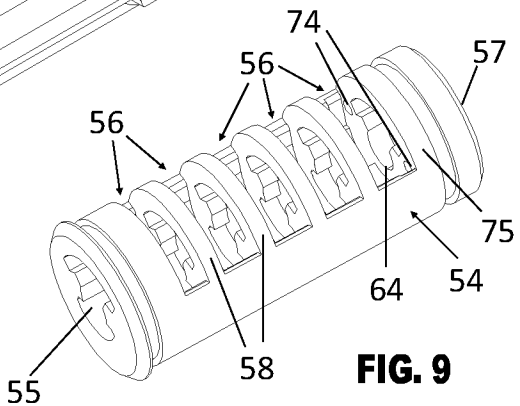
FIG. 9 is another simplified perspective illustration of the plug, showing chambers for receiving therein plug locking elements.

Reference is additionally made to FIGS. 6 and 9. Cylinder lock 10 includes a plug 54 which includes a plurality of chambers 56, separated by walls 58, for receiving therein plug locking elements 60 (not shown here, and are described more in detail hereinbelow). Chambers 56 may be of equal width or may have different widths. For example, in the illustrated embodiment, there are five chambers 56; four chambers are sized to receive therein three plug locking elements or two plug locking elements and a pair of movable security catches, and another chamber sized to receive therein two plug locking elements with no movable security catches.

Of course, the invention is not limited to these configurations. A threaded hole 62 (FIG. 6) may be formed at an end of plug 54 for receiving fastener 47 (FIG. 4) that changes the key into a turn knob, as will be explained further below.

Figure 20:
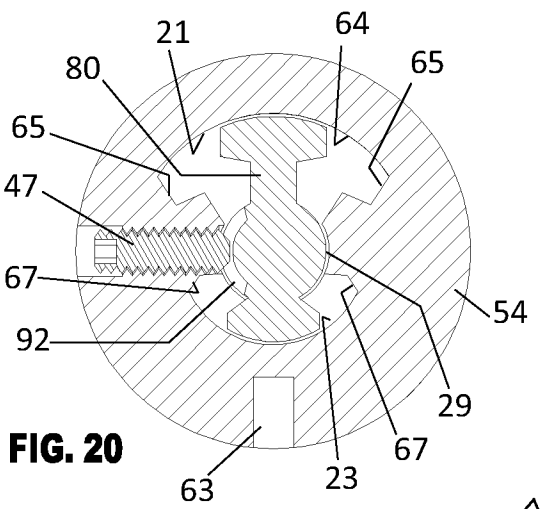
Figure 25:
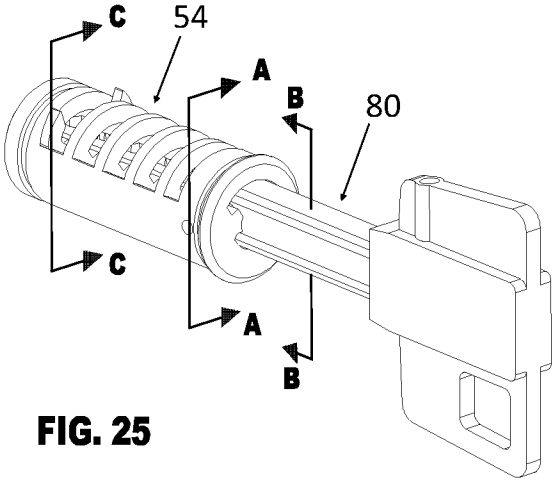
FIG. 25 is a simplified pictorial illustration of the key inserted into the cylinder plug.

FIGS. 6 and 9 show the distal end 57 of plug 54, which is the end opposite to the key insertion end 55, also called keyway 55. As seen in FIGS. 6, 9 and 20, bearing surfaces 64 are formed for supporting the key as it turns, as described further below. The bearing surfaces 64 may include diametrically opposed upper and lower arcuate surfaces 21 and 23, and diametrically opposed arcuate ears 29. Upper and lower arcuate surfaces 21 and 23 terminate in upper and lower key abutment surfaces 65 and 67, respectively.

The distal end 57 of the plug 54 is formed with a recess 66 (FIG. 6) for receiving therein a spring-loaded coupling 68 (FIGS. 4, 26 and 27) and two blind holes 70 for receiving therein springs 72 (FIGS. 4 and 27) of the coupling 68. As seen in FIG. 9, holes 74 are formed in a distal end wall 75, for receiving therein the pivoting portion of the movable security catches 96, described below with reference to FIG. 13. Coupling 68 interfaces with a standard cam 76 (FIGS. 3 and 4), and other kinds of cams, as is well known in the art.

Plug 54 is formed with an abutment 73 (seen in FIG. 27) for the key to abut against, as is explained below. As seen in FIG. 20, plug 54 is also formed with a lower recess 63, for receiving therein side bar 50.

Manufacture of Cylinder Lock Body and Plug

Metal injection molding (MIM) is a manufacturing technique for making complex machined or investment cast parts. MIM merges injection molding and powdered metal technologies by blending a polymer with an extremely fine metal powder. The blended material is then melted and injection molded to produce intricately formed parts that are repeatable in high production manufacturing.

In the MIM method, a metal-filled or a metallic powder-filled plastic is injected into a mold. Upon removal from the mold, the part still has in it plastic binders and the part is called a "green part". The part is then cured, cooled and the plastic binding matrix is removed from between the metal particles. The part is then sintered, and due to the fine powders used, the density of the molded component dramatically increases. Afterwards, MIM components can have mechanical, wear, and corrosion resistance properties equivalent to machined material.

The cylinder lock body (chassis 12 and half-shells 14 and 16) and plug 54 may be preferably made by MIM, e.g., using a stainless steel alloy, such as but not limited to, 17-4PH, a precipitation hardening martensitic stainless steel. Most of these parts have low weight (e.g., not more than 50 g) and substantially uniform wall thickness (including the walls 58 of plug 54). The investment in molds for the MIM process can be significantly less (10% of the cost) than the investment in transfer machines commonly used in making brass cylinder locks. With the MIM process, one can manufacture a cylinder lock out of hardened metal, such as steel, as opposed to the weaker brass. However, even though MIM is preferred for reducing costs and maintaining good manufacturing tolerances, it is recognized that all of the parts may be made by other methods, such as machining.

Key Blank/Key 80

Figure 18:
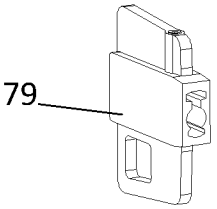
FIGS. 18, 19A and 19B are simplified life-size and two enlarged illustrations, respectively, of a key head of the key used to operate the cylinder lock of FIG. 3, in accordance with an embodiment of the present invention.
Figure 19B:
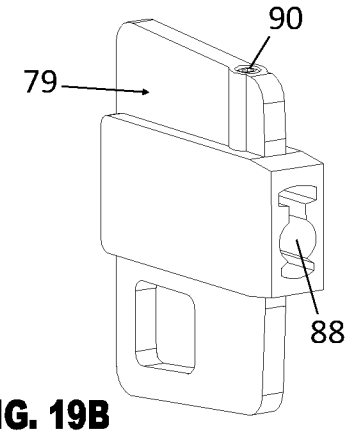
Figure 19A:
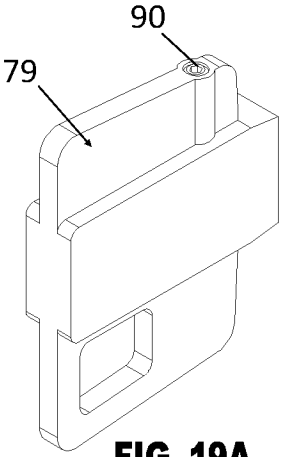

Reference is now made to FIGS. 3, 4, 10, 11, 26 and 27, which illustrate a key shaft 78 of a key 80 used to operate the cylinder lock of FIG. 3, in accordance with an embodiment of the present invention. Before any key cuts are made, key 80 is also referred to as key blank 80, and the terms key and key blank will be used interchangeably throughout the specification and claims, except for when the key cuts are discussed, at which time it is a key and not a key blank. Key shaft 78 may be made of metal, such as but not limited to, cold drawn nickel silver; alternatively, key shaft 78 may be made by MIM. A key head 79 is provided, made of metal or plastic, and is also shown in FIGS. 18, 19A and 19B. If made of metal, key head 79 can be made by MIM; if made of plastic, it may be made by injection molding, for example.

A reference abutting structure 82 is formed at a distal portion of key shaft 78, such as a flat surface formed at the distal end of a rail portion 84 of key shaft 78. The reference abutting structure 82 abuts against abutment 73 of plug 54, as clearly seen in FIGS. 9, 25, 26 and 27. The axial positions for making key cuts 86 along shaft 78 of the key blank 80 (shown as dimensions A1-A5 in FIG. 26, although the invention is not limited to five key cut positions) are defined with respect to reference abutting structure 82. This also means that the axial positions for the plug locking elements 60 (described below), which correspond to the same axial positions of the corresponding key cuts 86, are defined with respect to reference abutting structure 82. This is in contrast with the prior art, in which the positions of the key cuts are defined from the proximal end of the key, not the distal end.

Figure 26:
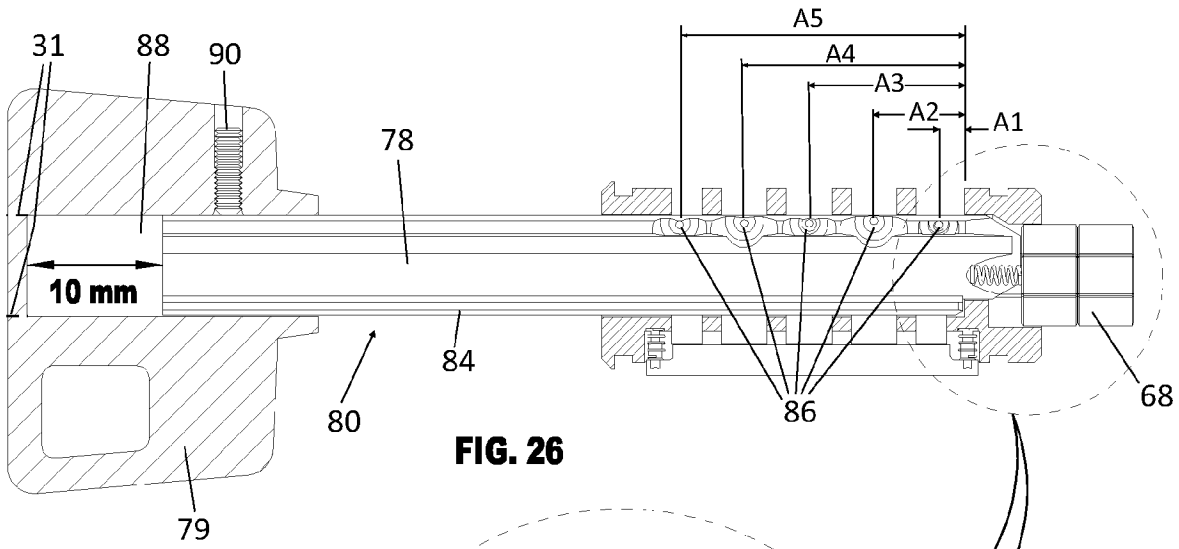
FIGS. 26 and 27 are simplified sectional and enlarged sectional illustrations, respectively, of the key inserted into the cylinder plug, taken along section lines B-B in FIG. 25, and showing an adjustable position of the key head, abutting against the plug and interfacing with a coupling of the cylinder lock.
Figure 27:
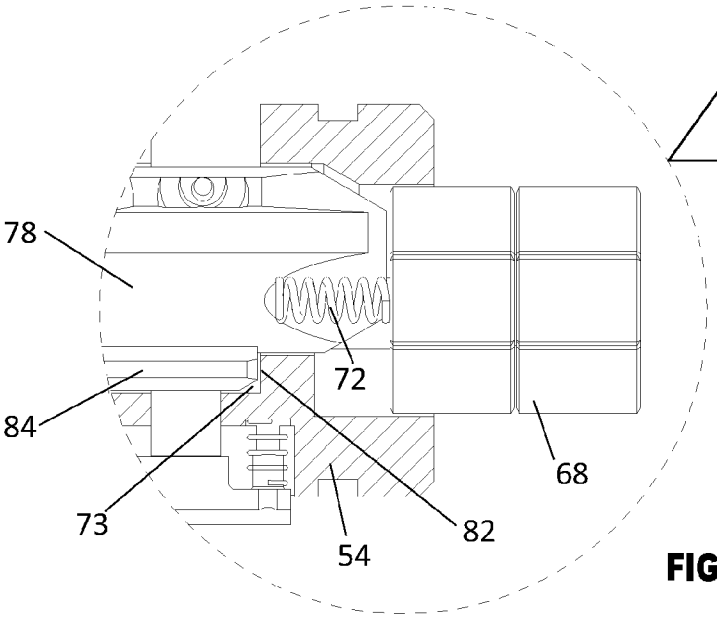

Since the key cuts 86 of the present invention are referenced with respect to the distally located reference abutting structure 82, the proximal end of the key shaft 78 can protrude towards the proximal end (i.e., outwards towards the user away from the cylinder lock) at any desired length. As seen clearly in FIG. 26, this enables the key 80 to have an adjustable length as measured from the proximal end of key head 79 to the distal end of the key 80. One of way of achieving this is by forming key head 79 with a channel 88 in which the proximal end of key shaft 78 is inserted. The key shaft 78 simply slides in channel 88 and key head 79 is secured at the desired length with a fastener (e.g., set screw) 90. Channel 88 may be a blind channel as illustrated in FIG. 26. Alternatively, channel 88 may open through the proximal end of the key head 79 (as indicated by broken lines 31 in FIG. 26), wherein key shaft 78 passes through key head 79 and is cut flush with the proximal end of key head 79.

Key shaft 78 is formed with a lateral recess 92 into which is received fastener 47. The way in which fastener 47 turns the key 80 into a turning knob is explained further below with reference to FIG. 24.

Key shaft 78 is formed with an actuating structure 94, such as one or more laterally protruding surfaces formed near or on a flat surface of a rail portion 84 of key shaft 78. The actuating structure 94 actuates movable security catches 96, as will be explained further below with reference to FIGS. 28-32.

It is noted that there are prior art keys with key cuts that can be identified simply by visual inspection by an experienced individual. Unscrupulous individuals can copy keys in this way without even physically copying the original key; they know the key code by visual inspection alone and cut this key code in a key blank. In contrast, in the present invention, key cuts 86 have features that look different than the prior art and make knowing the key code by visual inspection extremely difficult. First, the key cuts 86 are made at an angle, which is difficult to identify by mere visual inspection. Second, the shallowest possible key cut is not a cut that merely "skims" the surface (which would be easily recognizable as the shallowest possible cut for the particular set of possible key cuts); rather it is a bona fide key cut that is definitely not flush with the surface of key shaft 78 and whose depth is not easily discernible as the shallowest possible cut.

Master Keying

In the prior art, there is a limited, finite space in a cylinder lock plug for adding master key elements. This is a disadvantage, especially in large modern lock systems that have several hierarchical levels, such as a grand-master key blank at the top level of the system, one or more master key blanks at a medium level and several change key blanks at the lowest level. The additional master key elements add complexity to the assembly, can jam and lower security against picking.

The key of the present invention can easily be integrated in a master key system, with any hierarchy of master or grand-master keys and change keys. In an example of one system, different sets of movable security catches (pairs of catches on both sides of the key or even a single catch on one side of the key) may be placed in the plug. The master or grand-master key can be formed with one combination of actuating structure 94 that actuates all of the movable security catches, whereas the lower hierarchical level keys can be made to actuate only some of the catches. This may be accomplished by simply filing, grinding or otherwise voiding places on the actuating structure 94 of the lower hierarchical level keys so that the altered places cannot actuate the movable security catches. This altering procedure may be done on or off site. In addition, because the invention allows asymmetrical placing of movable security catches (e.g., one movable security catch one side of the key), it is possible to make a lower hierarchical level key that can only lock but not unlock, or vice versa, only unlock but not lock. There is no need for additional master key elements.

Movable Security Catches 96

Figure 13:
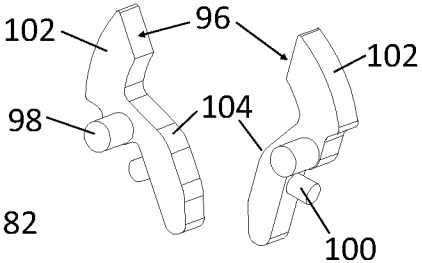
FIGS. 12 and 13 are simplified life-size and enlarged illustrations, respectively, of a pair of movable security catches used in the cylinder lock of FIG. 3, in accordance with an embodiment of the present invention.
Figure 12:
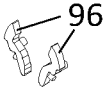

Reference is now made to FIGS. 12 and 13. Each movable security catch 96 pivots on a pivot 98 which fit into hole 74 (FIG. 9) of plug 54. (The pair of movable security catches 96 are minor images of each other.) Each movable security catch 96 is biased by a biasing device 99, e.g., a coil spring (FIGS. 4, 23 and 28-32), which fits on a prong 100 jutting from security catch 96. Each movable security catch 96 has an annular claw 102 that extends radially outwards from pivot 98, and an arcuate key abutting surface 104 that extends radially inwards from pivot 98. Movable security catches 96 may be made by MIM.

It is noted that this is just one example of movable security catches 96 and other security catches can be employed to carry out the invention, such as security catches which slide.

Figure 5B:
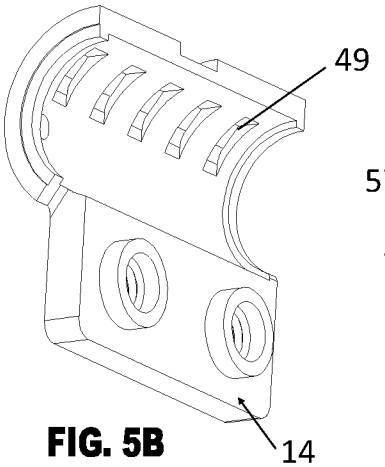
FIGS. 5A and 5B are two simplified perspective illustrations of a first half-shell that makes up part of the cylinder lock body of the cylinder lock of FIG. 3.
Figure 7B:
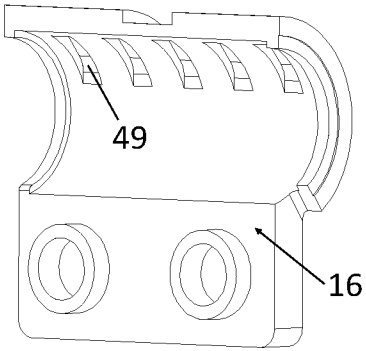
FIGS. 7A and 7B are two simplified perspective illustrations of a second half-shell that makes up part of the cylinder lock body of the cylinder lock of FIG. 3.
Figure 5A:
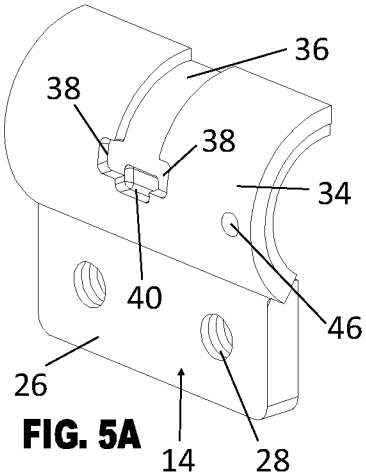
Figure 7A:
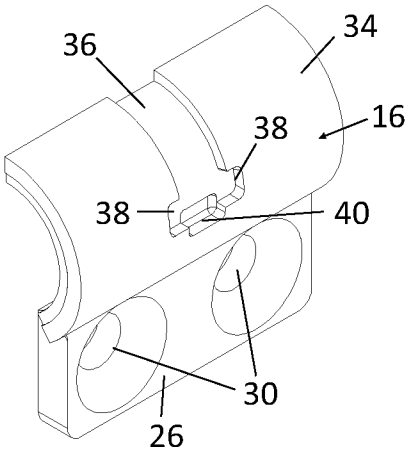
Figure 24:
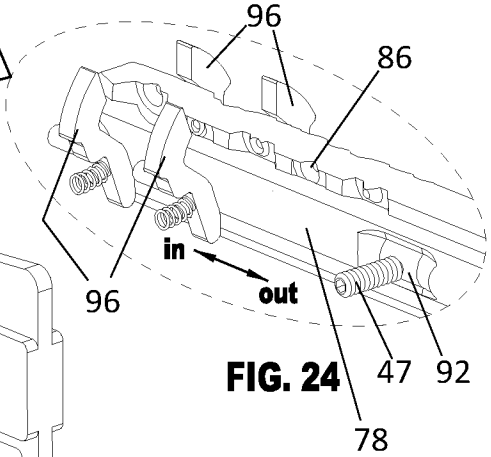
FIGS. 23 and 24 are simplified pictorial and enlarged illustrations, respectively, of the key interfacing with the movable security catches and with a securing element that turns the key into a turning knob for use on the inside of the door, in accordance with an embodiment of the present invention.

More than one set of movable security catches 96 may be provided and they may be located anywhere along the plug 54. For example, FIGS. 5B and 7B show that trap grooves 49 may be formed along a plurality of positions on the inner side of the half-cylindrical walls 34 for receiving therein one or more sets of movable security catches 96. FIG. 24 shows an example of more than one set of movable security catches 96.

Side Bar 50

Figure 15:
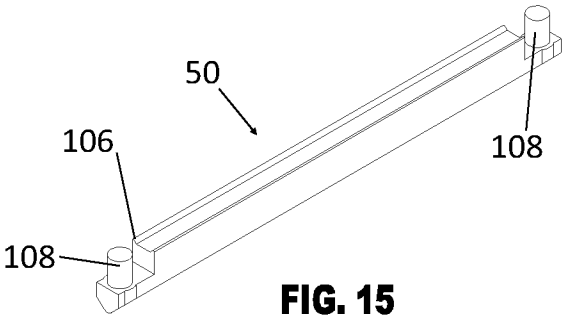
FIGS. 14 and 15 are simplified life-size and enlarged illustrations, respectively, of a side bar used in the cylinder lock of FIG. 3, in accordance with an embodiment of the present invention.
Figure 14:
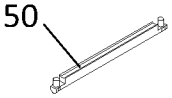

Reference is now made to FIGS. 14 and 15, which illustrate side bar 50. Side bar 50 has elongate ridges 106, which can get caught on plug locking elements 60 to make picking difficult, as is described further below. Biasing devices 52 (FIG. 4) are mounted on two lugs 108 on side bar 50. Side bar 50 may be made by MIM and hardened. It is noted that all parts in the present invention which are made by MIM may be hardened; however, if a riveting operation is to be performed on the part, it is preferable not to harden the metal.

Plug Locking Element 60

Figure 16:
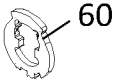
FIGS. 16, 17A and 17B are simplified life-size and two enlarged illustrations, respectively, of a plug locking element used in the cylinder lock of FIG. 3, in accordance with an embodiment of the present invention.
Figure 17B:
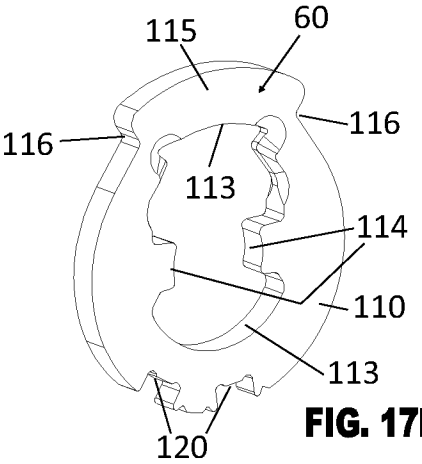
Figure 11:
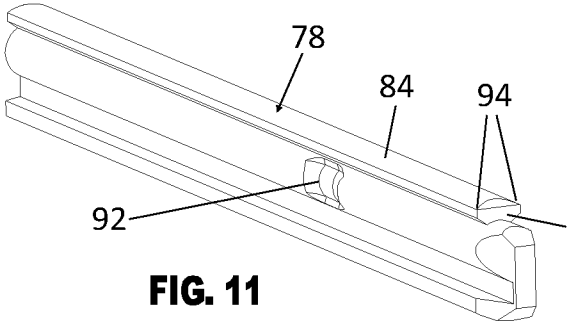
FIGS. 10 and 11 are simplified life-size and enlarged illustrations, respectively, of a key shaft of a key used to operate the cylinder lock of FIG. 3, in accordance with an embodiment of the present invention.
Figure 17A:
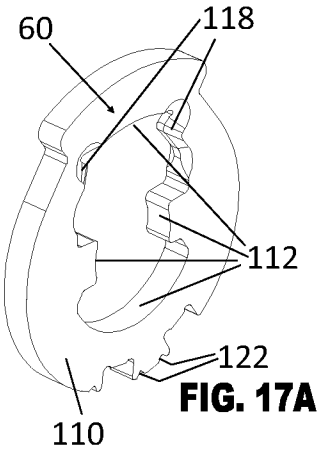
Figure 10:
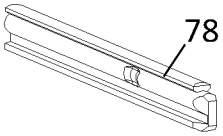

Reference is now made to FIGS. 16, 17A and 17B, which illustrate plug locking element 60. In this embodiment, plug locking element 60 is a disk that partially rotates about the longitudinal axis of the plug 54. Plug locking element 60 has a round body 110 formed with a plurality of inner bearing surfaces 112 for the key 80 to slide and turn against. The inner bearing surfaces 112 may include diametrically opposed upper and lower arcuate surfaces 113 and diametrically opposed arcuate ears 114. Plug locking element 60 has a crown portion 115 extending from an upper portion of round body 110. The junction of crown portion 115 with round body 110 defines two (left and right) inner shoulders 116 which can abut against shoulders 103 (FIG. 35) of plug 54 only when manipulated by a tool other than the key. Key cut interface probes 118 are formed on inner surfaces of plug locking element 60; probes 118 interface with the key cuts 86, as will be explained further below. Side bar receiving grooves 120 are formed on the lower outer contour of round body 110. The grooves 120 may be separated from one another by a portion of round body 110 on which peripheral trap notches 122 are formed. The elongate ridges 106 (FIG. 15) of side bar 50 can get caught in notches 122 to make picking difficult, as is described below with reference to FIG. 35A.

Inner Key Can Serve as Turning Knob

Figure 23:
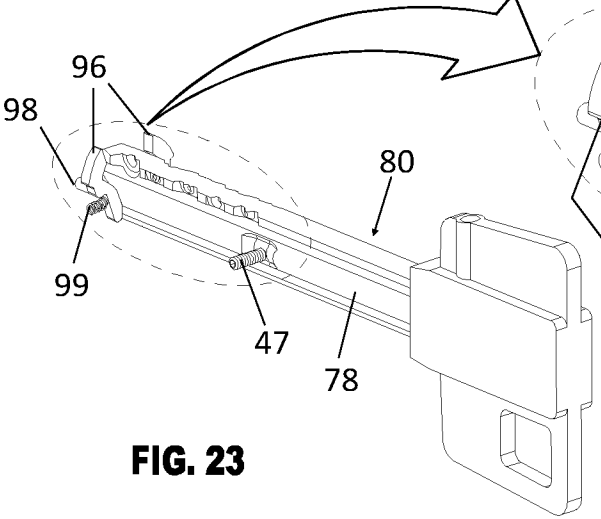

Reference is now made to FIGS. 23 and 24, which shows fastener 47 received in lateral recess 92 of key shaft 78. Fastener 47 is not tightened completely against key shaft 78; rather key shaft 78 can turn and slide with respect to fastener 47 up to the limits defined by the boundaries of lateral recess 92. Recess 92 is preferably formed on all keys, regardless of whether the key is used as a knob or not. Accordingly, fastener 47 permits axial movement of the inner key up to the proximal end wall of lateral recess 92, meaning the key cannot be removed from the cylinder lock. Thus the key serves as a turning knob on the inside of the door. The permitted axial movement has another purpose: it allows a user to insert a key in the plug on the outside of the door, turn the key (since it has the correct key cuts), and push the coupling 68 in order to connect with cam 76 (FIG. 4) and operate the cylinder lock, all this despite the presence of the turn-knob key on the inside of the door. In other words, the permitted axial movement permits the coupling 68 to move axially to connect with cam 76. (The capability of moving the coupling 68 axially may also be seen by examining FIGS. 26 and 27.)

After returning key 80 to the vertical position, biasing device 72 pushes key 80 in the direction out of the plug 54; this spring force helps to pull the key 80 out of the plug 54. It is noted that the key 80 does not have to be perfectly vertical in order to remove it from plug 54. This is due to the key cuts 86 having slanted walls and to the biasing force (that is, the spring or urging force) of the biasing devices 52 of the side bar 50.

Figure 47:
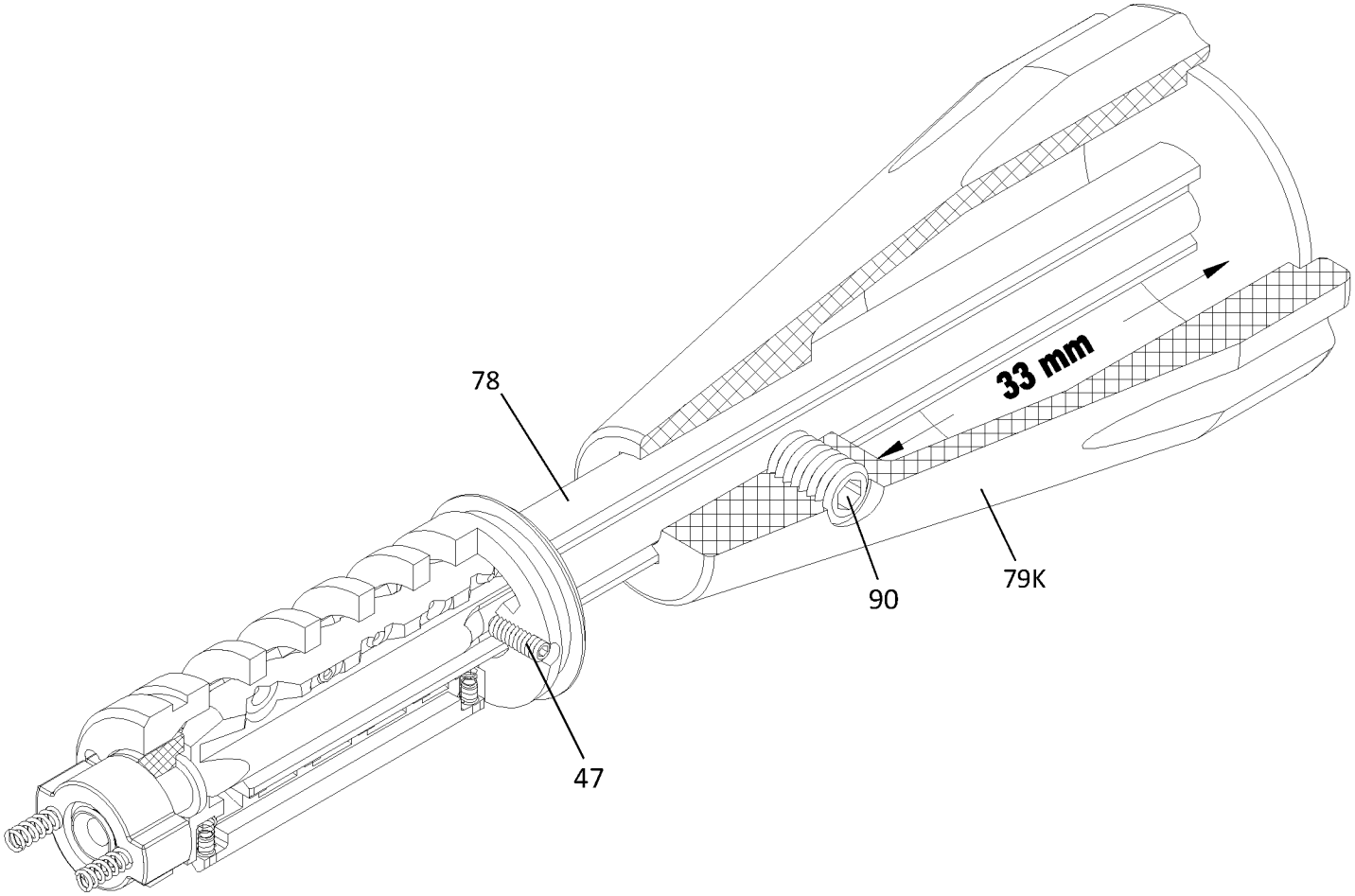
FIG. 47 is a simplified pictorial illustration of a key configured as a knob on the inside of the cylinder lock of FIG. 3, in accordance with an embodiment of the present invention.

FIG. 47 illustrates that the key head can be fashioned as a knob 79K on the inside of the cylinder lock, in accordance with an embodiment of the present invention. The axial adjustment of knob 79K along key shaft 78 can be substantial, such as but not limited to, 33 mm. Again, the key head does not have to be fashioned as knob 79K and a regular key head 79 can serve as the turning knob.

Operation of Cylinder Lock with Key having Correct Key Cuts

Figure 22:
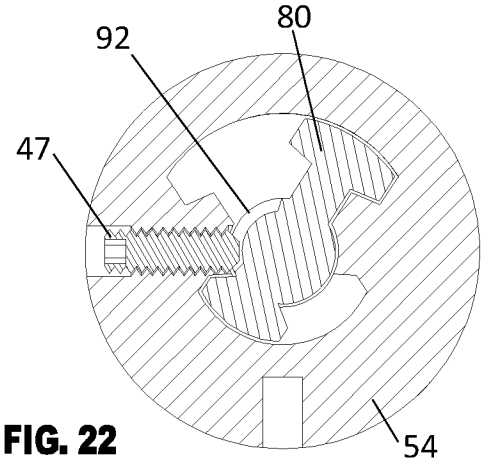
FIGS. 20, 21 and 22 are simplified sectional illustrations of three different positions of the key inserted into the cylinder lock of FIG. 3, in accordance with an embodiment of the present invention, taken along section lines A-A in FIG. 25.
Figure 21:
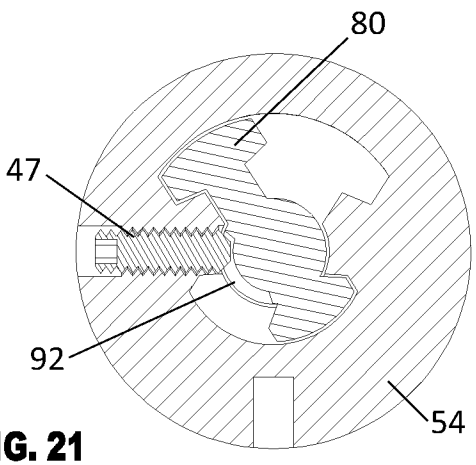

Reference is now made to FIGS. 20, 21 and 22, which illustrate key 80 inserted into plug 54. Key 80 is fully inserted in plug 54, and in FIG. 20 has not yet been turned. The key cut interface probes 118 have abutted against key cuts 86 (not shown here, but seen in FIGS. 40-46 described a few paragraphs below), and the key 80 can be turned either counterclockwise (FIG. 21) or clockwise (FIG. 22). The upper and lower parts of the key profile can abut against the upper and lower key abutment surfaces 65 and 67, respectively, upon turning the key; however, the key can be turned further only if the key has the correct key cuts. The further turning of the key 80 causes the plug 54 to rotate either counterclockwise or clockwise, by moving movable security catches 96 out of trap grooves 49 and side bar 50 into grooves 120, as is explained now with reference to FIGS. 28-32. It is noted that movable security catches 96 can be placed anywhere in the wider chambers 56 of plug 54. There can be more than one pair of catches 96 on both sides of the key 80 or even a single catch 96 on one side of the key 80.

Figures 28, 29, 30, 31, 32:
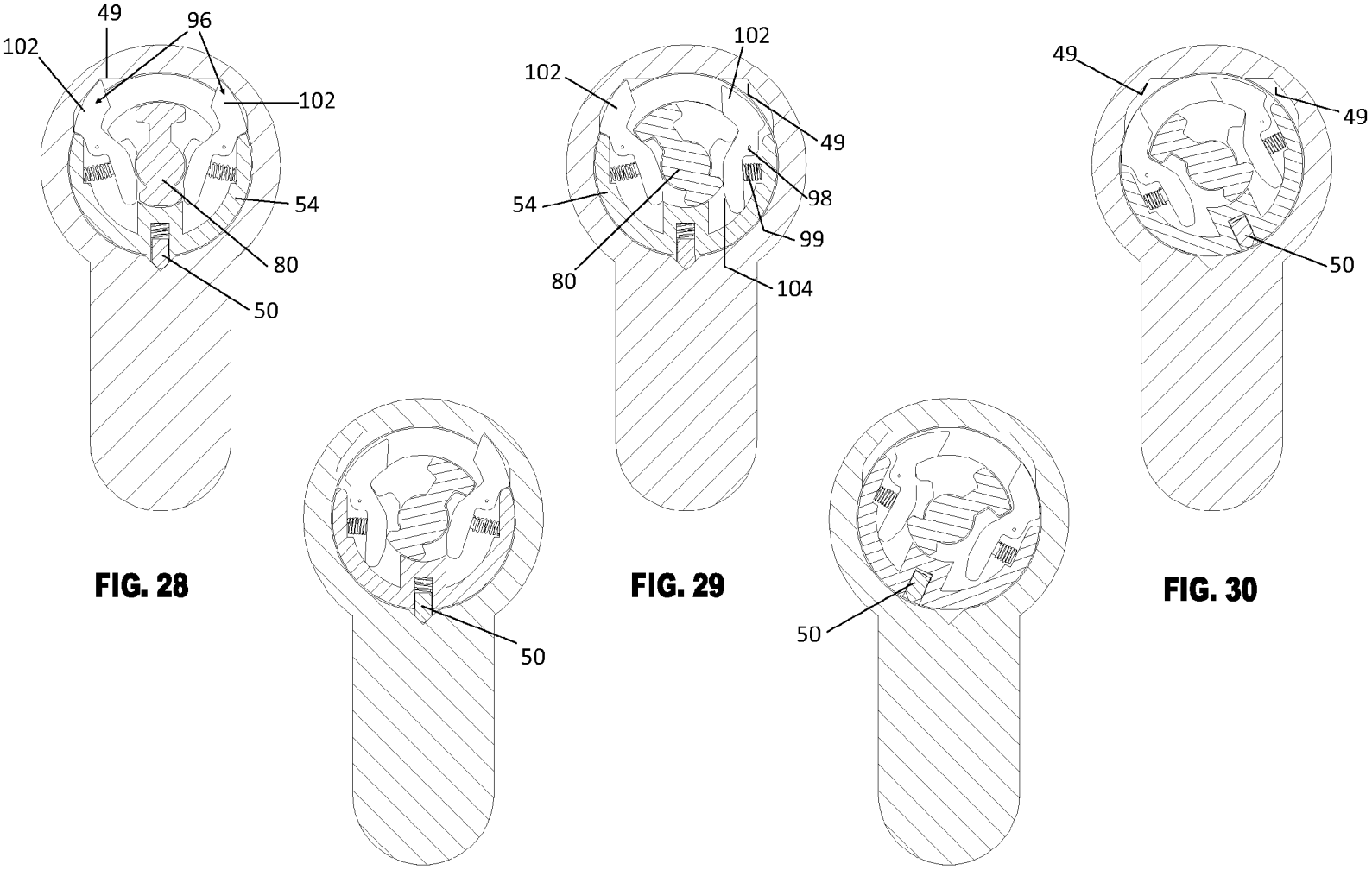
FIGS. 28-32 are simplified sectional illustrations of five (5) different positions of the key inserted into the cylinder lock of FIG. 3, in accordance with an embodiment of the present invention, taken along section lines C-C in FIG. 25, and showing operation of the movable security catches.

Reference is now made to FIGS. 28-32. In FIG. 28, key 80 has been inserted in the cylinder lock but has not yet been turned. The annular claw 102 of security catch 96 is initially trapped in trap groove 49. In FIG. 29, key 80 with the correct key cut combination has been turned counterclockwise. A portion of the key pushes against the key abutting surface 104 of the right movable security catch 96, compressing its biasing device 99. The right security catch 96 pivots about pivot 98 and its annular claw 102 moves out of trap groove 49. The key 80 can now turn plug 54 fully in the counterclockwise direction (to FIG. 30), because the right security catch 96 no longer blocks rotation of the plug 54; the left security catch 96 also does not prevent rotation of the plug 54 because its annular claw 102 is free to move out of its trap groove 49 when plug 54 is turned counterclockwise (the heel of claw 102 simply slides out of the groove 49). Conversely, in FIG. 31, key 80 with the correct key cut combination has been turned clockwise. A portion of the key pushes against the key abutting surface 104 of the left movable security catch 96, compressing its biasing device 99. The left security catch 96 pivots about pivot 98 and its annular claw 102 moves out of trap groove 49. The key 80 can now turn plug 54 fully in the clockwise direction (to FIG. 32), because the left security catch 96 no longer blocks rotation of the plug 54; the right security catch 96 also does not prevent rotation of the plug 54 because its annular claw 102 is free to move out of its trap groove 49 when plug 54 is turned clockwise.

Reference is now made additionally to FIGS. 33-39. These figures illustrate another section of the key inserted and turned in the cylinder lock. As mentioned before, one can clearly see (especially noted in FIG. 35) that the key cuts 86 can be asymmetrical, that is, different key cuts can be made on the two sides of the key.

Figure 39:
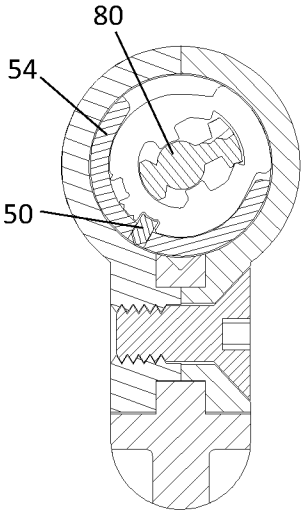
FIGS. 35-39 are simplified sectional illustrations of five (5) different positions of the key inserted into the cylinder lock, in accordance with an embodiment of the present invention, taken along section lines E-E in FIG. 33.
Figure 38:
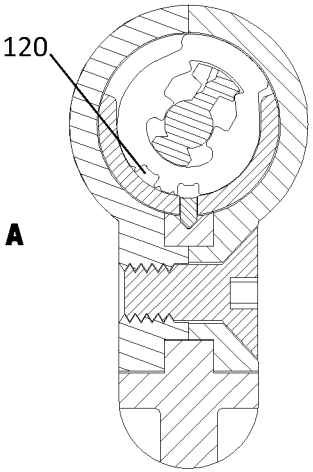
Figure 37:
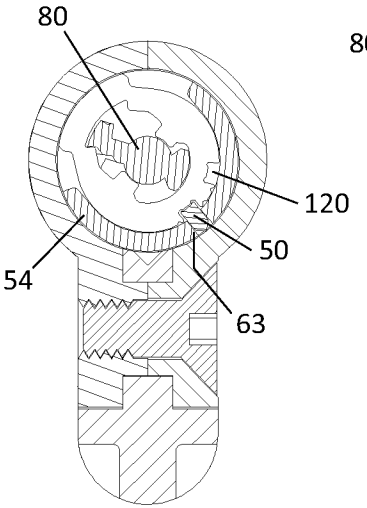

Upon rotation of the plug locking elements 60, as seen in FIGS. 37-39, side bar 50 enters one of the side bar receiving grooves 120 of plug locking elements 60. Side bar 50 then does not prevent rotation of the plug 54.

Figure 35A:
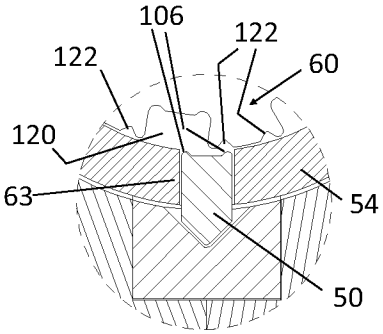
FIG. 35A is an enlarged sectional illustration of the sidebar with respect to recesses formed in the plug locking element, in accordance with an embodiment of the present invention, showing anti-cylinder lock-picking notches.
Figure 34:
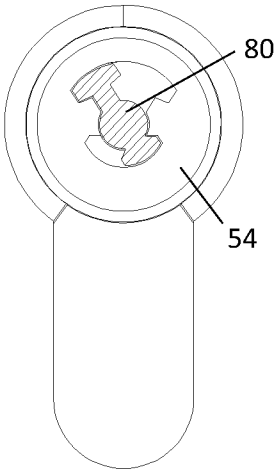
FIG. 34 is a simplified sectional illustration of the key inserted into the cylinder lock, fully turned and poised to rotate the plug to actuate the cylinder lock, taken along section lines D-D in FIG. 33.
Figure 33:
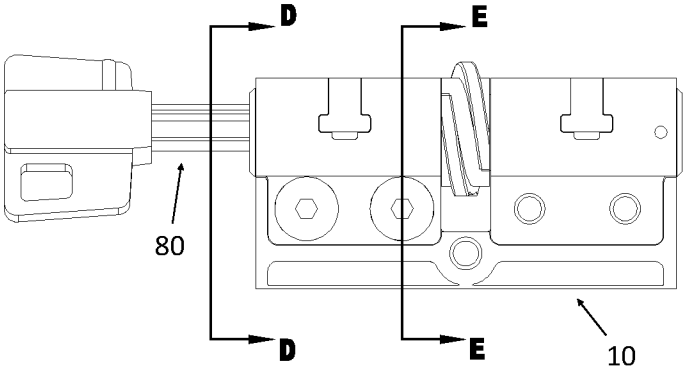
FIG. 33 is another simplified pictorial illustration of the key inserted into the cylinder lock of FIG. 3.
Figure 35:
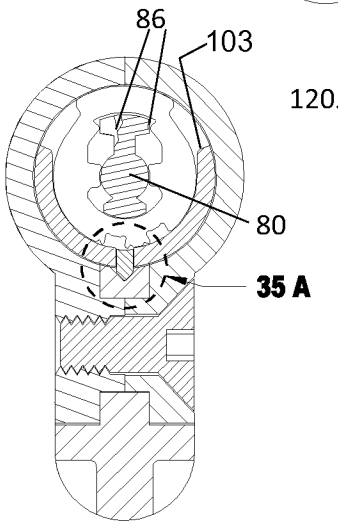
Figure 36:
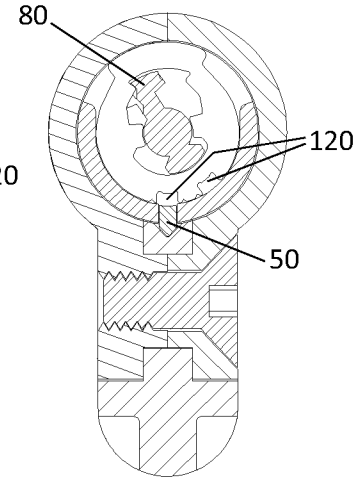

Referring to FIG. 35A, it is seen that the elongate ridges 106 of side bar 50 can get caught in notches 122 of plug locking elements 60 if a would-be cylinder lock picker were to apply a torque on plug 54 and try to move the plug locking elements 60 to the shear line (that is, the positions that permit rotating plug 54).

Reference is now made to FIGS. 40-46, which illustrate the key cut interface probes 118 of plug locking elements 60 interfacing with key cuts 86 formed on the key shaft 78 of key 80. For the sake of clarity, the crown portions 115 have been removed from plug locking elements 60 to better show key cut interface probes 118 interfacing with key cuts 86. It is seen in FIG. 41, that the key cuts 86 can be asymmetrical, that is, different key cuts can be made on the two sides of the key. The key cuts 86 may be angled 11.5° from the vertical as shown, but the invention is not limited to this angle.

One Possible Door Installation

Figure 50:
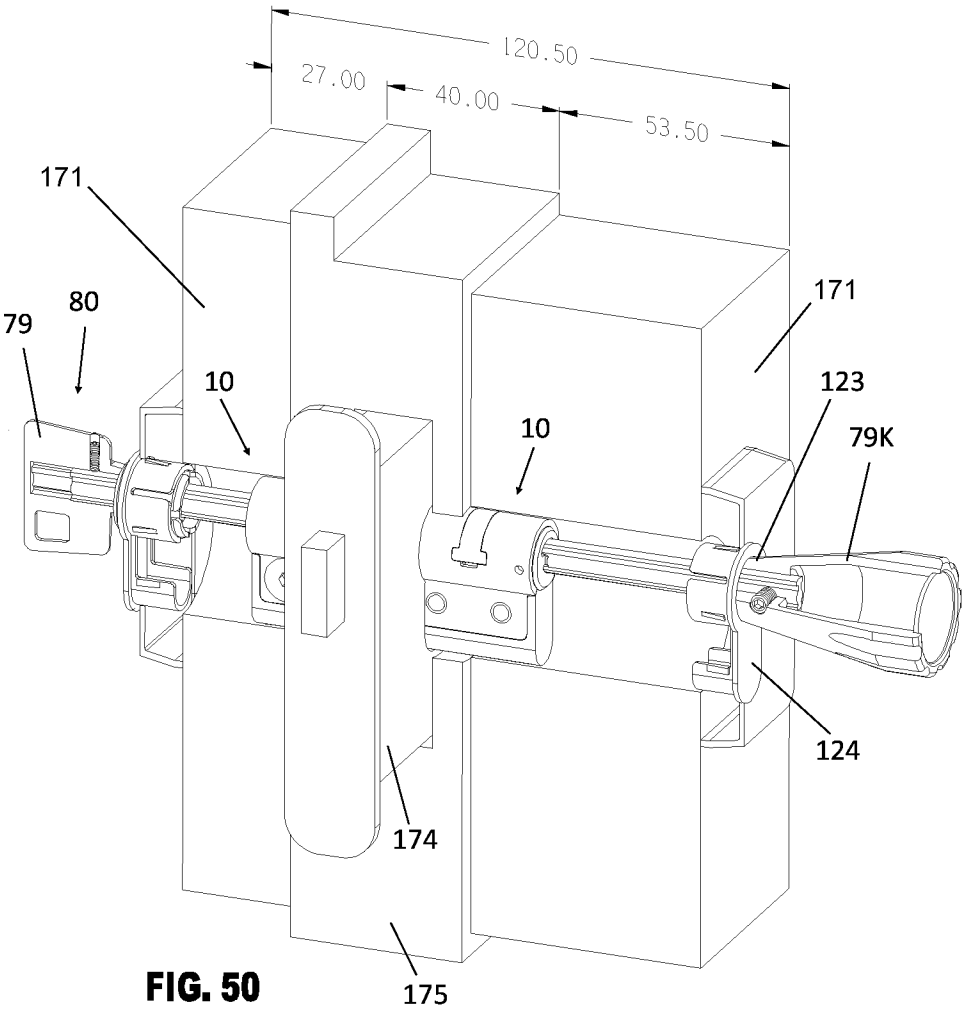
FIG. 50 is a simplified pictorial illustration of a mortise lock in a door, showing the inside and outside of the cylinder lock of the present invention, in accordance with an embodiment of the present invention.

Reference is now made to FIGS. 47-50. FIG. 50 illustrates a mortise lock 174 in a door 175, showing the inside (right side in the drawing) and outside of the cylinder lock 10. Door 175 may have a greater thickness than typical doors because of the addition of decorative panels 171, and yet the same cylinder lock used for thinner doors can be used with this thicker door, as is now explained.

Figure 48:
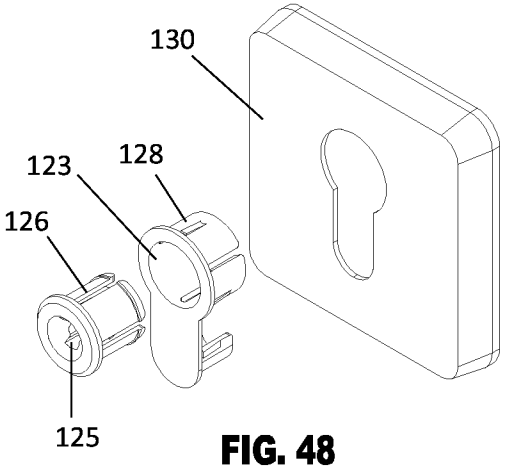
FIG. 48 is a simplified pictorial illustration of a bushing, rosette and escutcheon used on the outside of the cylinder lock of FIG. 3, in accordance with an embodiment of the present invention.
Figure 49:
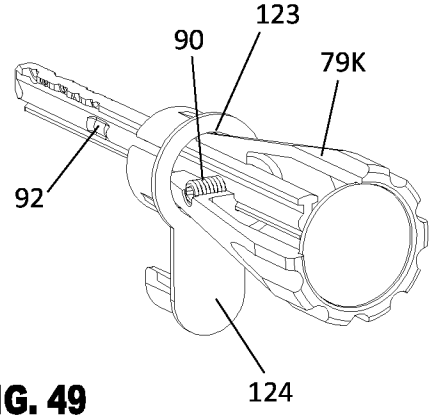
FIG. 49 is a simplified pictorial illustration of the knob of FIG. 47 with a rosette on the inside of the cylinder lock, in accordance with an embodiment of the present invention.

As mentioned before, FIG. 47 illustrates that the key head can be fashioned as knob 79K on the inner side of the cylinder lock (right side of FIG. 50). Knob 79K is rotatingly supported in an opening 123 formed in a rosette 124 (FIGS. 49 and 50) on the inside of the cylinder lock. The outer side of the cylinder lock (left side of FIG. 50) is operated by key 80, which is rotatingly supported in a bushing 126, which fits and turns in a rosette 128, which fits in an escutcheon 130 (FIG. 48). Bushing 126 may be easily removed from and re-installed in rosette 128, which may be easily removed from and re-installed in escutcheon 130. Key shaft 78 fits through a keyway opening 125 formed in bushing 126. The rosette assembly (rosette 124 or the combination of bushing 126 rotating in rosette 128) serves as a bearing for rotatingly supporting key 80, no matter how far the cylinder lock is distanced from the key head 79 or 79K. Since the key head 79 is adjustable along the length of key 80, key head 79 may be distanced much farther from the keyway than the prior art cylinder locks, which makes picking and tampering even more difficult. The dimensions shown in FIG. 50 are exemplary and the invention is not limited to these values.

Of course, the regular key 80 with its key head 79 can also serve as the knob. Thus the key 80 is reversible—it can be employed as a turning knob and switched to being a regular (non-knob) key and vice versa. This of course means the cylinder lock is reversible, too.

The invention can provide very significant savings in inventory, installation and logistics for lock providers/installers. With the present invention, since the key length is adjustable by sliding the key head on the shaft, one cylinder lock is installable in a wide variety of door thicknesses; indeed, the dimensions of the door thickness is not important with this feature. One can easily choose between a knob or key at the inside of the door and the choice is reversible.

Other Kinds of Plug Locking Elements

In the following figures, other kinds of plug locking elements are described. The plug locking elements are still disposed in "chambers"; these chambers may be holes or other kinds of openings.

Figures 51, 52:
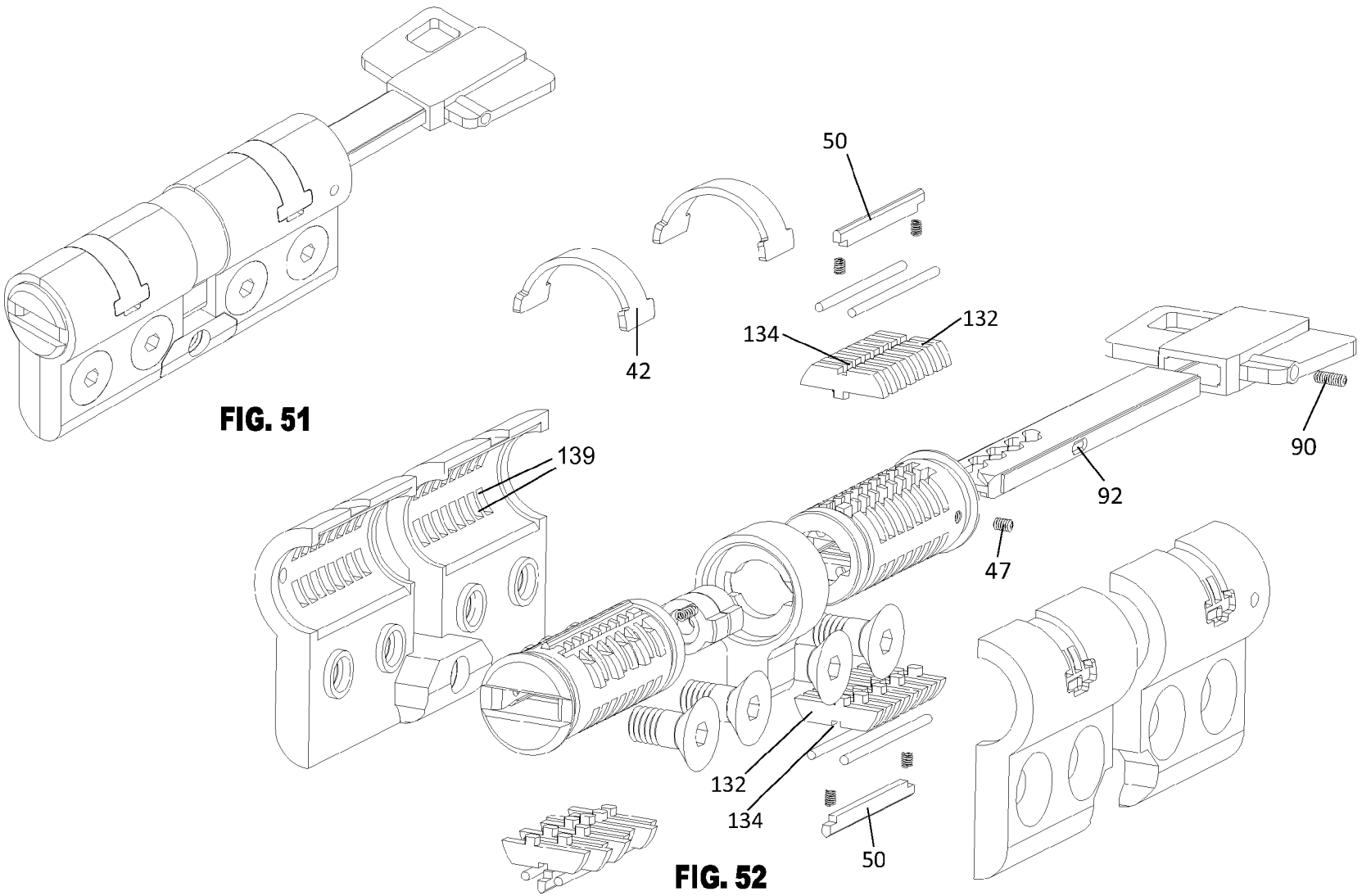
FIGS. 51 and 52 are simplified pictorial and exploded illustrations, respectively, of a cylinder lock, constructed and operative in accordance with an embodiment of the present invention, employing plug locking elements which are wafers (also called wafer tumblers or slider tumblers)

Reference is now made to FIGS. 51 and 52, which illustrate a cylinder lock that employs plug locking elements which are wafers 132, which may be formed with a notch 134 for side bar 50. Examples of such plug locking elements are the sliders in U.S. Pat. No. 4,977,767 (assigned to EVVA), and the terms "wafer" and "slider" are used interchangeably. In operation of the cylinder lock, the wafers or sliders 132 move in and out of grooves or recesses 139 formed in the shells. These recesses are quite difficult to make with prior art techniques, but are easier and cheaper to make with the technique of MIM of the present invention.

Figures 53, 54, 55:
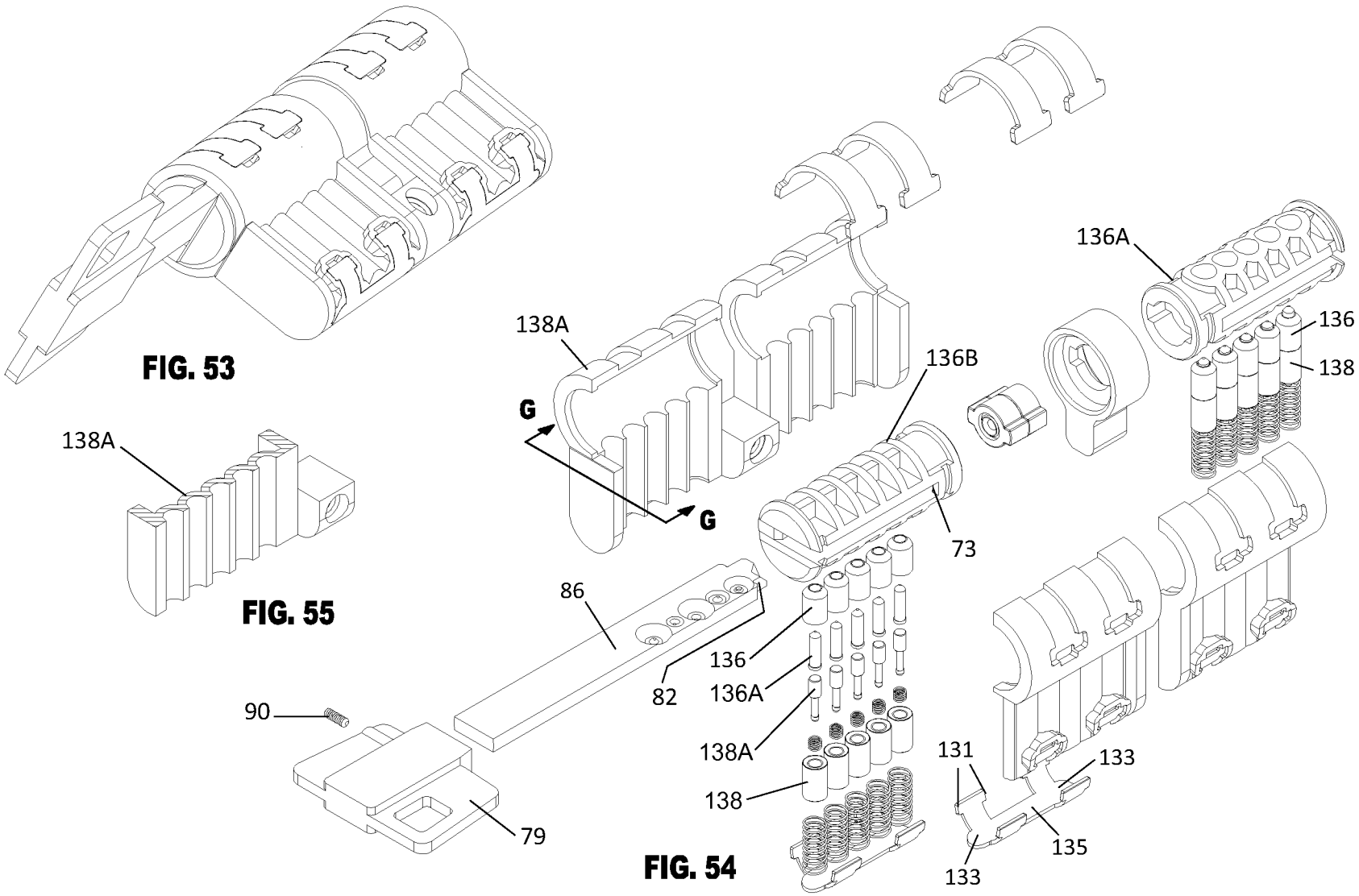
FIGS. 53 and 54 are simplified pictorial and exploded illustrations, respectively, of a cylinder lock, constructed and operative in accordance with an embodiment of the present invention, employing plug locking elements which are telescoping pins.
FIG. 55 is a sectional, pictorial illustration of a section of one of the half-shells of the cylinder lock of FIG. 53, taken along section lines G-G in FIG. 54.

Reference is now made to FIGS. 53, 54 and 55, which illustrate a cylinder lock that employs plug locking elements which are multi-element pins or telescoping pins, in the style of MUL-T-LOCK cylinder locks (such as that described in U.S. Pat. Nos. 4,856,309, 5,123,268, 5,520,035, 5,784,910, 5,839,308, 7,647,799 and 7,698,921). In the illustrated embodiment, there are outer telescoping plug pins 136 with inner telescoping plug pins 136A, and outer telescoping driver pins 138 with inner telescoping plug pins 138A. The key cuts 86 may be made by a key cutting or key duplicating machine (the terms being used interchangeably throughout), described below with reference to FIGS. 66-76.

In the illustrated embodiment, the resilient clasp 42 (may be identical to that of FIGS. 3 and 4) affixes the upper portions of the two half-shells to one another; no chassis is used. The lower portions of the two half-shells are affixed with a double resilient clasp, that is, two clasps 133 each formed with two outwardly extending tabs 131 at ends thereof. Clasps 133 are formed as one piece along with an axial connecting portion 135. The double clasp serves to close the openings for the lower elements of the multi-element pin assembly.

With this cylinder lock made by MIM, material is left for clasps 133 to mount on, yet there is substantially uniform wall thickness throughout. Additionally, as seen in FIG. 55, there is substantially uniform wall thickness in the structure of the half-shell 138A that forms the walls for the body (driver) pins 138 (FIG. 54). Additionally, as seen in FIG. 54, there is substantially uniform wall thickness in the structure of the plug 136A. There are substantially uniformly thick walls 136B that separate the chambers for the plug pins 136. When plug 136 is rotated in the body of the cylinder lock, the driver pins 138 do not fall into the places where material is missing (the chambers) because the driver pins 138 are aligned with the walls 136B. Thus, the driver pins 138 and 138A slide against walls 136B as plug 136 rotates. Here again, there is reference abutting structure 82 on key 80, which abuts against abuts against abutment 73 of plug 136A.

Figures 56, 57:
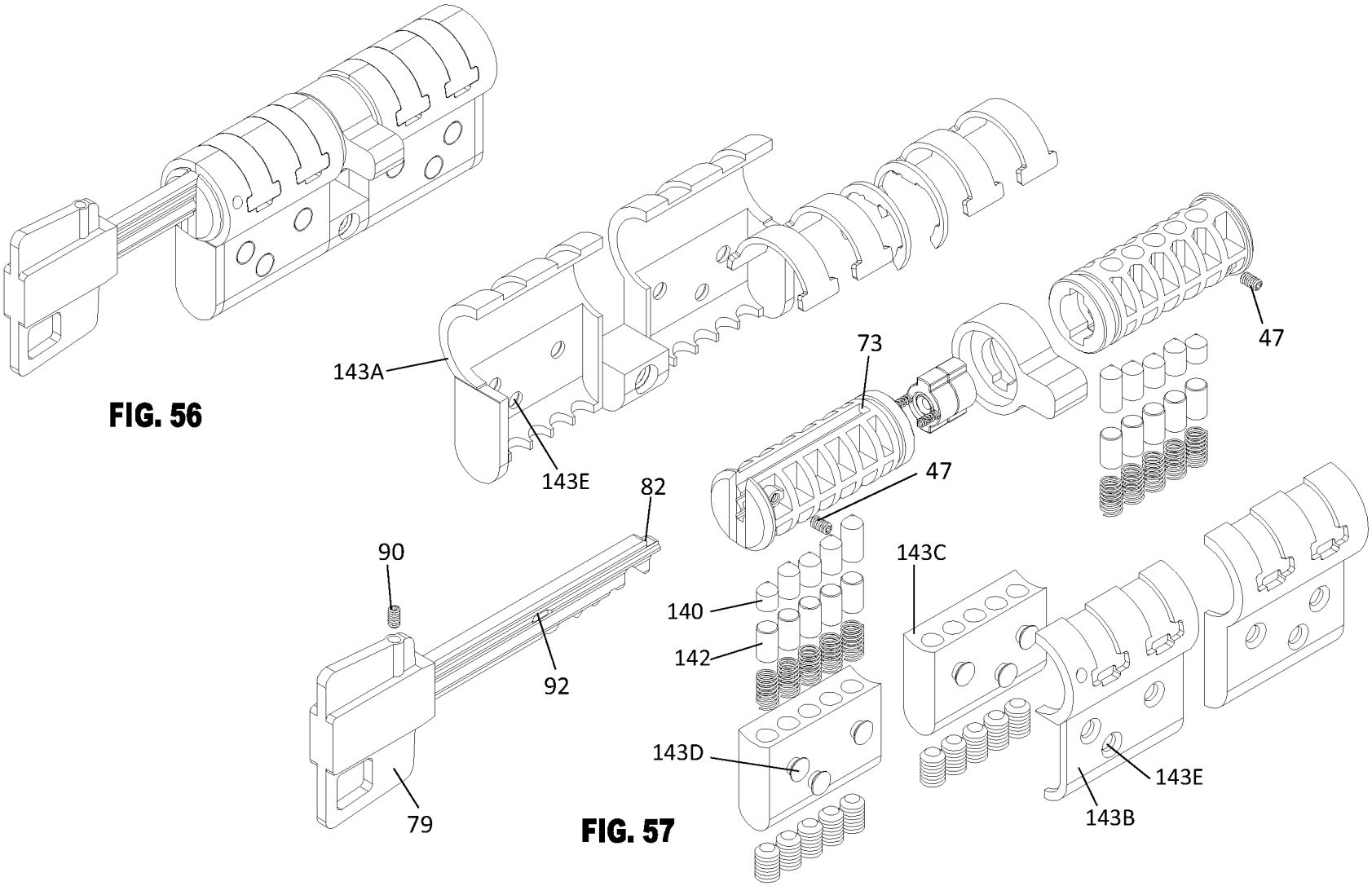
FIGS. 56 and 57 are simplified pictorial and exploded illustrations, respectively, of a cylinder lock, constructed and operative in accordance with an embodiment of the present invention, employing plug locking elements which are in-line pins.

Reference is now made to FIGS. 56 and 57, which illustrate a cylinder lock that employs plug locking elements which are in-line pins, e.g., plug pins 140 and driver pins 142.

The cylinder lock includes a cylinder lock body made of two half-shells 143A and 143B, attached to a chassis 143C. As with the other embodiments of the invention, the parts may be made by MIM. Chassis 143C is illustrated with straight walls, but may be made with walls that curve at the area of the holes for the driver pins 142 for reducing weight and maintaining substantially uniform wall thickness. Chassis 143C may have built-in rivets 143D that are fastened in mounting holes 143E of the half-shells 143A and 143B. The buck-tails of rivets 143D (the part that is placed through holes 143E) are bucked, upset, swaged or otherwise deformed after placement in holes 143E to form the rivet connection. Rivets 143D are positioned between holes 143F for the driver pins 142 so that the rivets get support from the chassis walls and do not collapse the holes.

Figure 60:
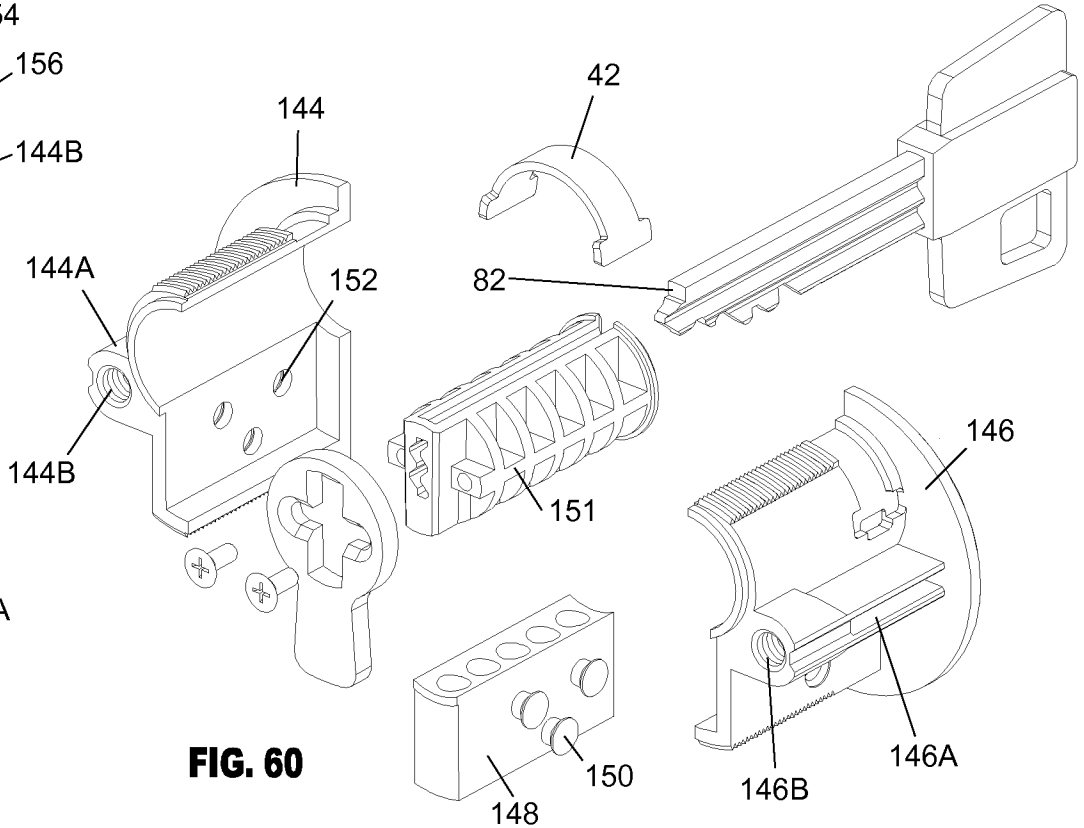
FIGS. 58, 59 and 60 are simplified pictorial, sectional and exploded illustrations, respectively, of a cylinder lock, constructed and operative in accordance with an embodiment of the present invention, wherein the cylinder lock is an American mortise cylinder lock with a threaded lock body.
Figure 58:
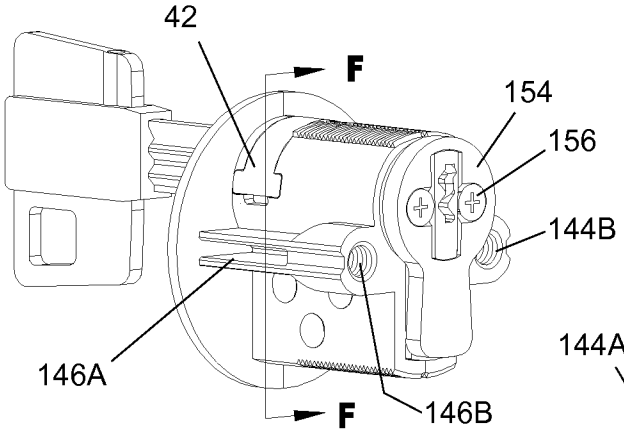
Figure 59:
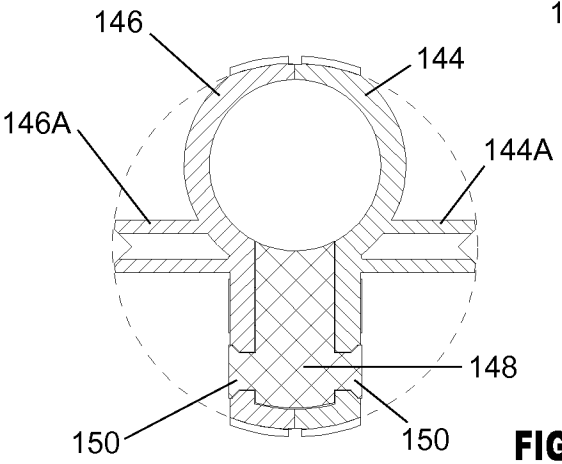
Figure 61:
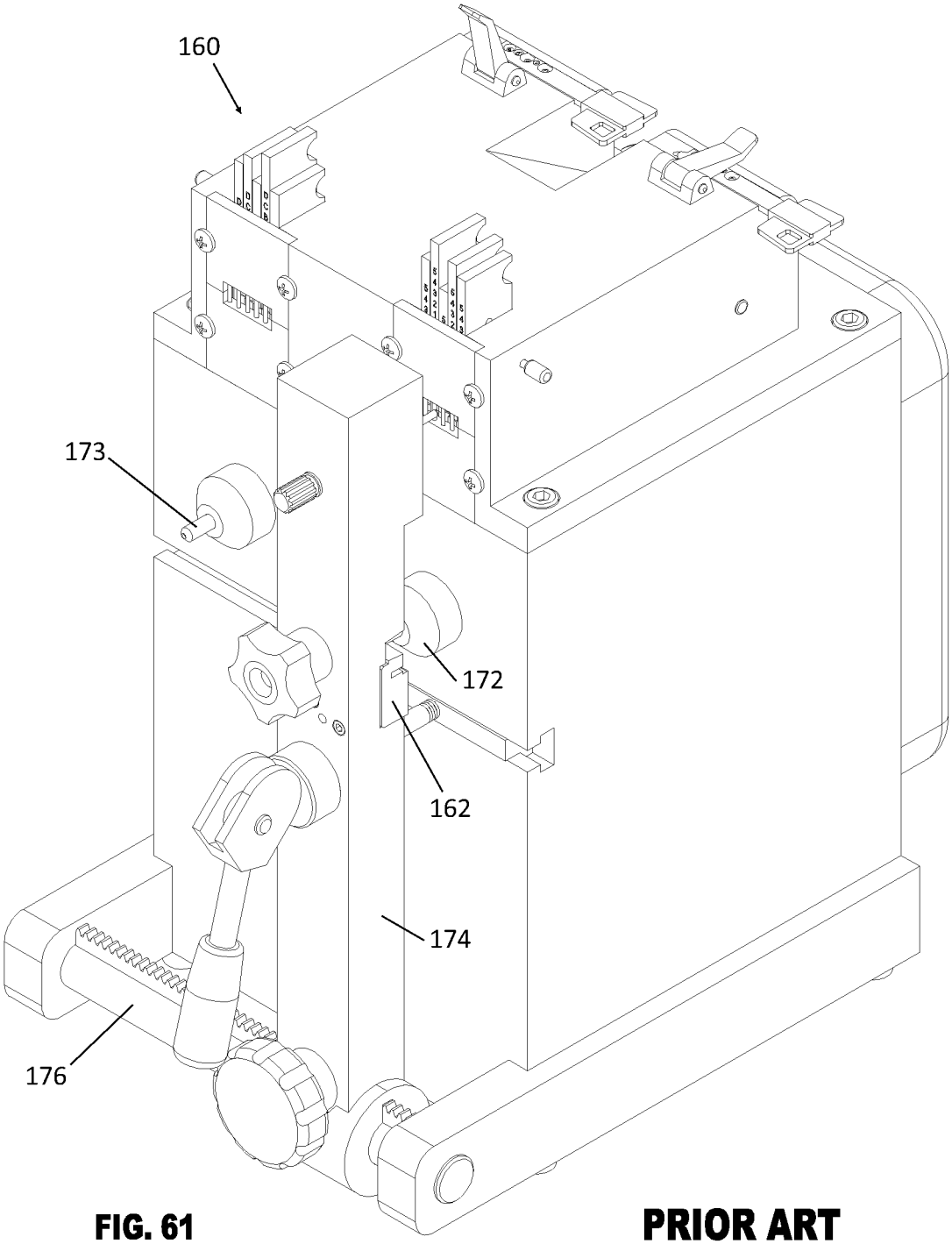
FIG. 61 PRIOR ART
FIG. 61 is a simplified pictorial illustration of a key cutting machine of the prior art.

Reference is now made to FIGS. 58, 59 and 60, which illustrate a cylinder lock, which is an American mortise cylinder lock with a threaded cylinder lock body made of two half-shells 144 and 146 formed with threads on a portion thereof, attached to a chassis 148. As with the other embodiments of the invention, the parts may be made by MIM with substantially uniform wall thickness. Chassis 148 may have built-in rivets 150 that are fastened in mounting holes 152 of the half-shells 144 and 146, as described before for rivets 143D of the previous embodiment. The plug 151 (preferably made of MIM with substantially uniform wall thickness) may operate a cam 154 fastened by mechanical fasteners (e.g., screws) 156.

The half-shells 144 and 146 are preferably formed with winged extensions 144A and 146A, respectively, which are designed to accept the screw (not shown) that fixes the cylinder lock in the door, which is the standard way of installing the American mortise cylinder lock. In this embodiment, the winged extensions are dimensioned to extend to the diameter of the root of the threads of the threaded cylinder lock body, which provides support while screwing the cylinder lock in the door. The circular broken line in FIG. 59 denotes the threaded hole into which the cylinder lock body is screwed.

Similarly, this embodiment can be modified accordingly to be a rim cylinder lock. For example, the winged extensions 144A and 146A may be respectively formed with threaded holes 144B and 146B for the rim cylinder lock installation. This feature saves on inventory costs—the same cylinder lock can be installed either as an American mortise cylinder lock or a rim cylinder lock, as desired.

Key Cutting Machine—Prior Art

Reference is now made to FIGS. 61-65, which illustrate a key cutting machine 160 of the prior art, such as the MUL-T-LOCK FULL SIZE or COMPACT II or KC-5 Key Cutting Machines, or the key cutting machines described in U.S. Pat. Nos. 6,602,030 and D441,379.

Figures 62, 63, 64:
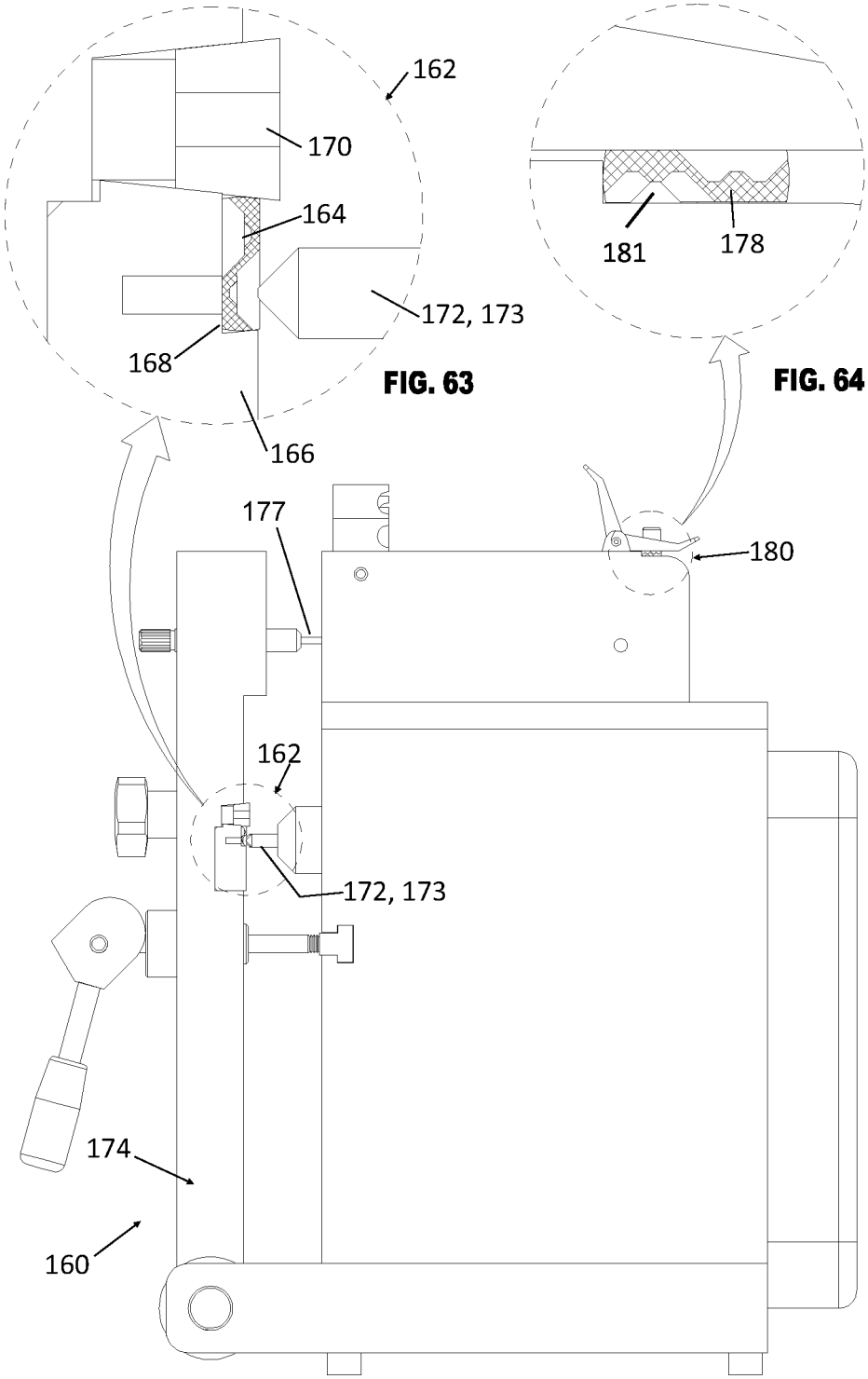
FIG. 62 PRIOR ART
FIG. 62 is a simplified side-view illustration of the key cutting machine of FIG. 61.
FIG. 63 is an enlarged illustration of a key holder to which the key is affixed in the key cutting machine of FIG. 61.
FIG. 64 is an enlarged illustration of a given key whose key cut codes are to be sensed for duplication.

The key cutting machine 160 includes a key blank clamping assembly 162 for securing a key blank 164 for cutting key cuts thereon. As seen in FIG. 63 (and also in FIGS. 71 and 72), the key blank clamping assembly 162 includes a holding chuck 166 with a recess 168 formed thereon in which the key blank 164 is received. A clamp 170 clamps the key blank 164 to chuck 166, so that a cutting tool 172 or 173 (FIG. 63) can make key cuts in key blank 164. Two cutting tools 172 and 173 are used to make key cuts for telescoping pins, as is known in the art. The key blank clamping assembly 162 can be moved from one cutting tool to another by means of a key blank translation assembly 174, mounted along a rack-and-pinion mechanism 176, for example.

Figure 65:
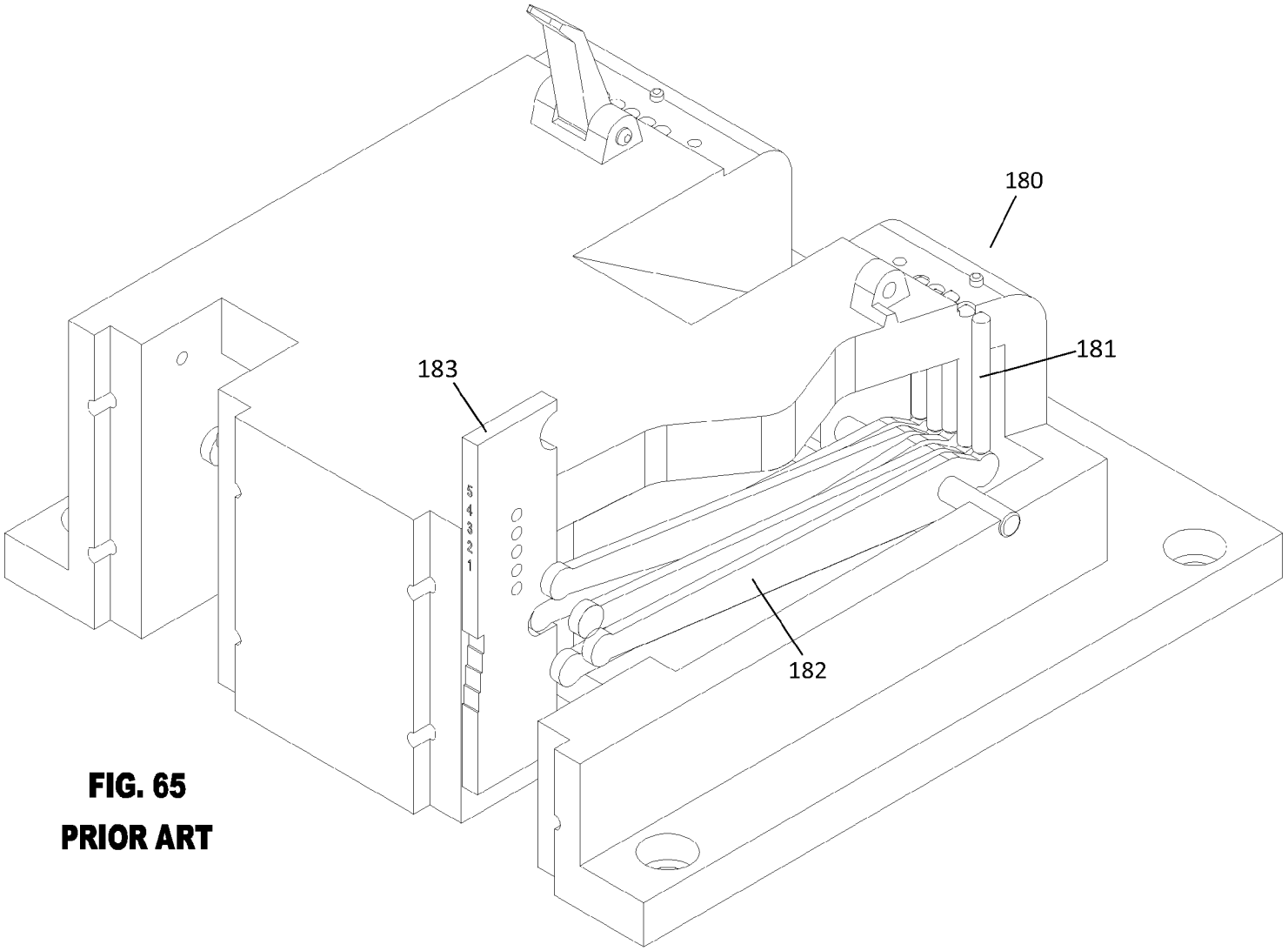
FIG. 65 PRIOR ART
FIG. 65 is a partially cutaway illustration of a key cut code reading device in the key cutting machine of FIG. 61.
Figure 67:
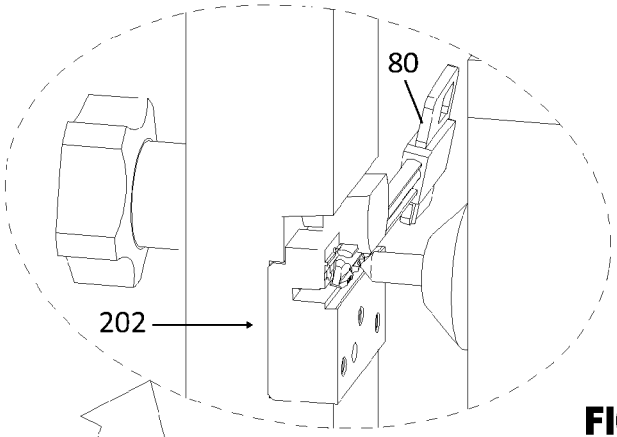
FIG. 67 is an enlarged illustration of a key holder of the key cutting machine of FIG. 66.
Figure 66:
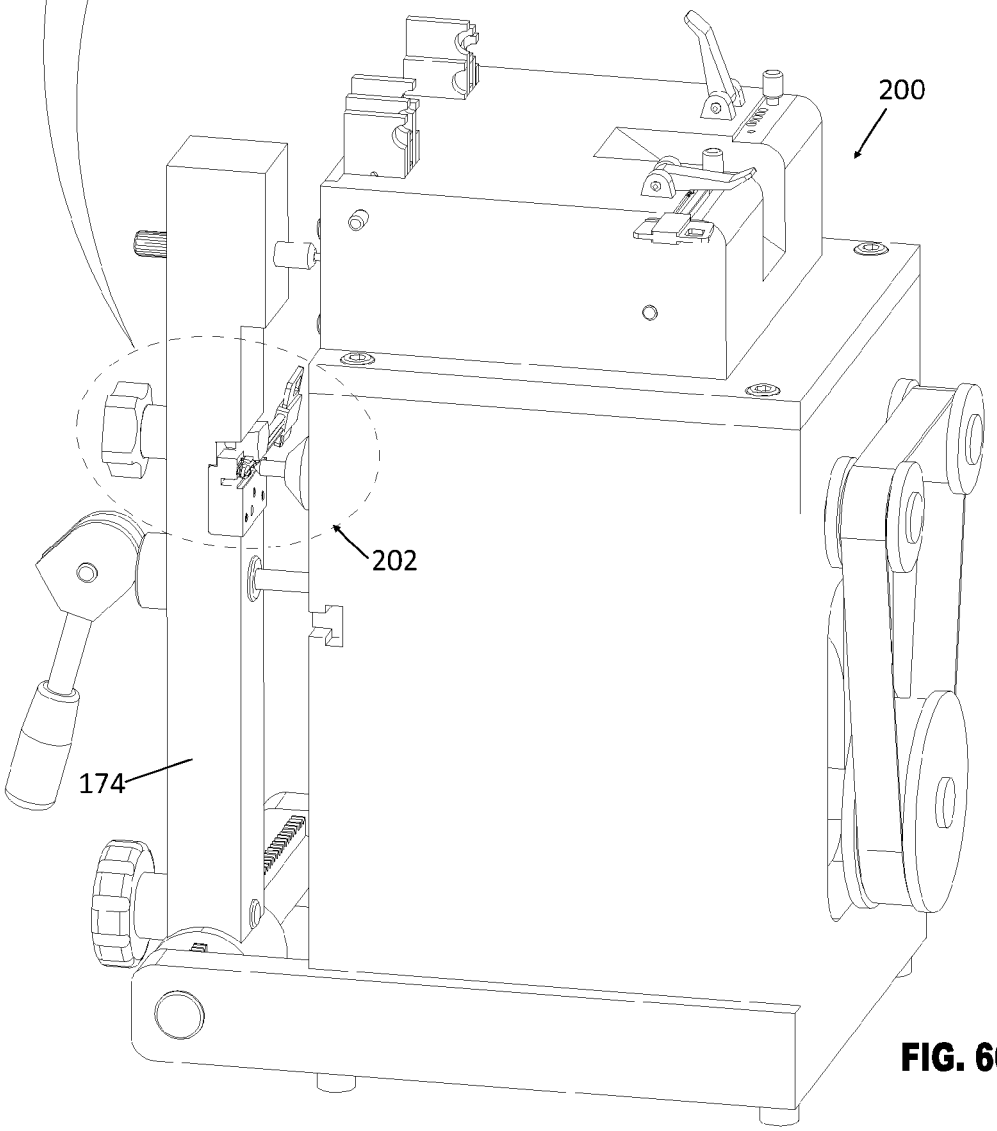
FIG. 66 is a simplified pictorial illustration of a key cutting machine, constructed and operative in accordance with an embodiment of the present invention.

If it is desired to duplicate the key cut code of a given key 178, a key cut code reading device 180 is provided, shown in FIG. 65. Key cut code reading device 180 employs depth probes 181, which are pins that probe the depths of the key cuts on the given key 178. The depth probes 181 push on ends of levers 182, whose other ends move a cutting template 183 into the proper cutting position for cutting tools 172 and 173. The key blank translation assembly 174 is provided with a probe 177 (FIG. 62) that follows the grooves on cutting template 183. The key blank translation assembly 174 pivots about rack-and-pinion mechanism 176 as probe 177 goes in and out of the grooves on cutting template 183 so that the key cuts are cut in accordance with cutting template 183. Thus, the key cut code reading device 180 follow or tracks the various depths or shapes of the key cuts of the given key 178, and the key cut shapes are mimicked by the cutting tools 172 or 173.

Key Cutting Machine of the Invention

Reference is now made to FIGS. 66-70 and 73-78, which illustrate a key cutting machine 200, constructed and operative in accordance with an embodiment of the present invention. The key cutting machine 200 employs a different key blank clamping assembly 202 than the key blank clamping assembly of the prior art, which permits cutting key cuts in the key 80 of the present invention, while also permitting cutting key cuts of the prior art in prior art keys. The illustrated embodiment of the key cutting machine 200 is based on the cutting machine 160 of the prior art. However, it is emphasized that the invention is not limited to such a key cutting machine; rather the invention provides a method and module for transforming (i.e., modifying or upgrading) a prior art key cutting machine into a key cutting machine that is capable of cutting key cuts in a first key for a first cylinder lock (e.g., a prior art key in a prior art cylinder lock) and also capable of cutting key cuts in a second key for a second cylinder lock (e.g., the key 80 for the cylinder lock 10 of the present invention), wherein the key cuts for the first and second keys are cut at different angles with respect to a key-shaft-width axis, as is now explained.

Figure 69:
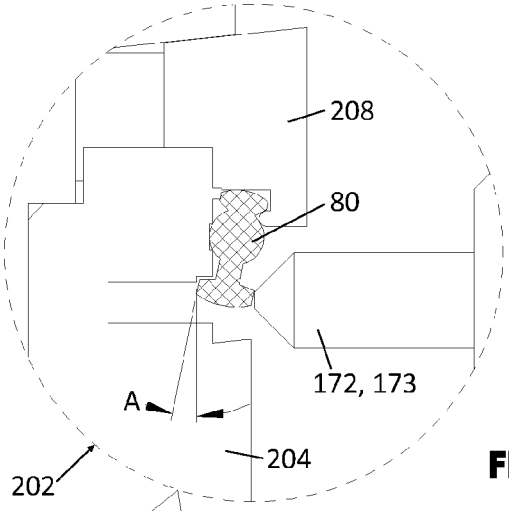
FIG. 69 is an enlarged illustration of the key holder holding a key of the present invention in the key cutting machine of FIG. 66.
Figure 74:
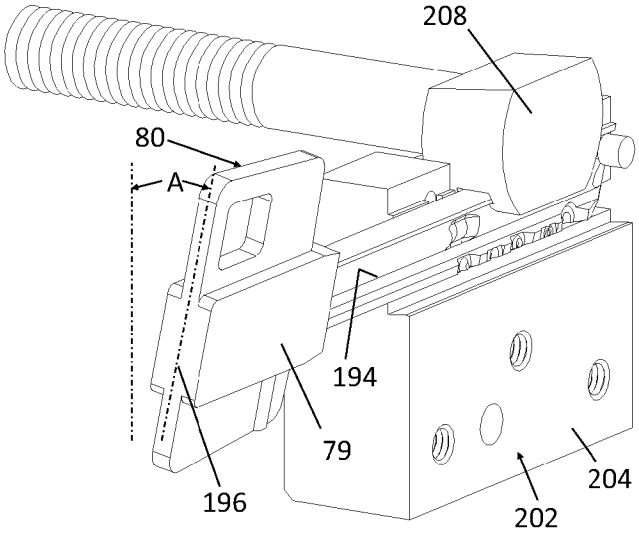
FIGS. 73 and 74 are pictorial illustrations of the key holder of the present invention, respectively with and without a key affixed therein.
Figure 73:
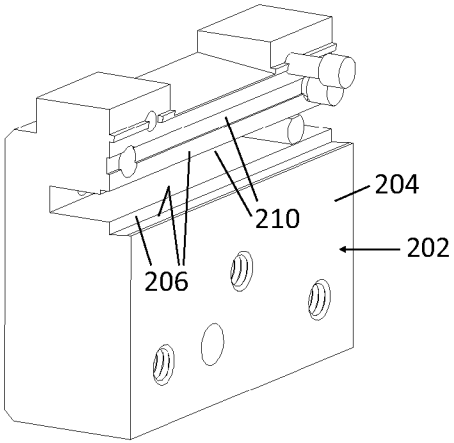

As seen in FIGS. 69, 73 and 74, key blank clamping assembly 202 includes a holding chuck 204 with a first key holding surface 206 formed thereon on which the first (e.g., prior art) key blank is mountable, and a clamp 208 that clamps the first key blank on first key holding surface 206. (FIGS. 75 and 76 illustrate the prior art key blank 164 mounted on first key holding surface 206 and held by clamp 208). Holding chuck 204 also includes a second key holding surface 210 formed thereon on which the second key blank (e.g., key blank 80 of the invention) is mountable; the clamp 208 also clamps the second key blank on second key holding surface 210. It is noted that the key blank can be inserted into the holding chuck 204 from either end of holding chuck 204.

Clamp 208 is formed with one or more surfaces 209 to abut against the first key blank and one or more surfaces 212 to abut against the second key blank. It is seen that surfaces 209 and 212 may be on opposite faces of clamp 208 so that clamp 208 is turned upside down when switching between clamping the two different key blanks.

Figure 72:
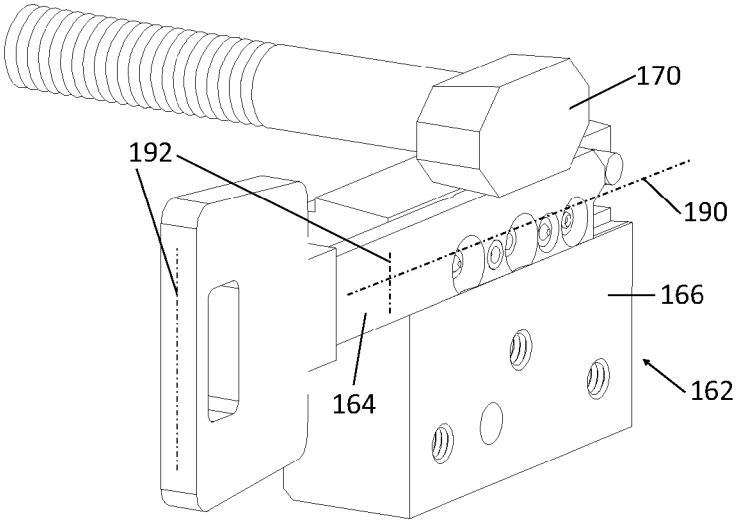
FIG. 72 PRIOR ART
FIGS. 71 and 72 are pictorial illustrations of the key holder of the prior art, respectively with and without a key affixed therein.
Figure 71:
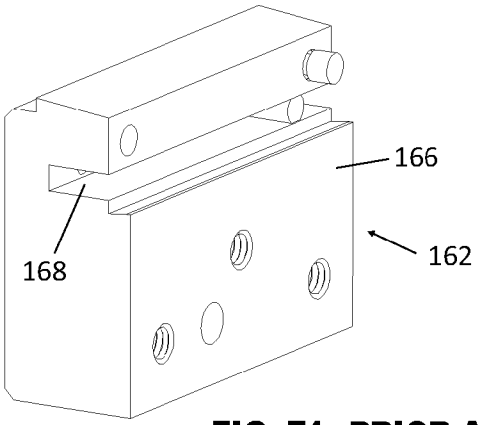
FIG. 71 PRIOR ART

As seen in FIG. 72, (first) key 164 has a key-shaft-length axis 190 and a key-shaft-width axis 192, perpendicular to key-shaft-length axis 190. (The key-shaft-width axis 192 also runs through the key head, as shown). When the key cuts are made in key 164, the key 164 is held so that key-shaft-width axis 192 is substantially vertical.

As seen in FIG. 74, (second) key 80 has a key-shaft-length axis 194 and a key-shaft-width axis 196, perpendicular to key-shaft-length axis 194. (The key-shaft-width axis 196 also runs through the key head 79, as shown). When the key cuts are made in key 80, the key 80 is held so that key-shaft-width axis 196 makes an angle A with the vertical. Thus, the key cuts for the first and second keys 164 and 80 are cut at different angles with respect to their respective key-shaft-width axes 192 and 196. As mentioned above, since the key cuts are made at an angle, key copying is difficult because it is difficult to identify the key cuts by mere visual inspection.

FIG. 69 illustrates that the cutting tools 172 and 173 can also be used to cut the key cuts on key 80 of the present invention in key cutting machine 200. As mentioned above, the shallowest possible key cut is definitely not flush with the surface of the key shaft and this depth is not easily discernible as the shallowest possible cut, making key copying difficult.

Figure 70:
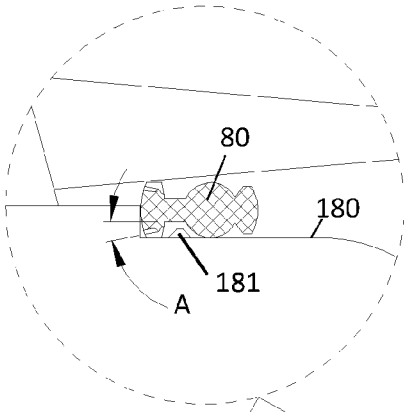
FIG. 70 is an enlarged illustration clearly showing the impossibility of reading the key cut code of the key of the present invention if the prior art key cut code reading device of the prior art key cutting machine is used with the key cutting machine of the present invention.
Figure 68:
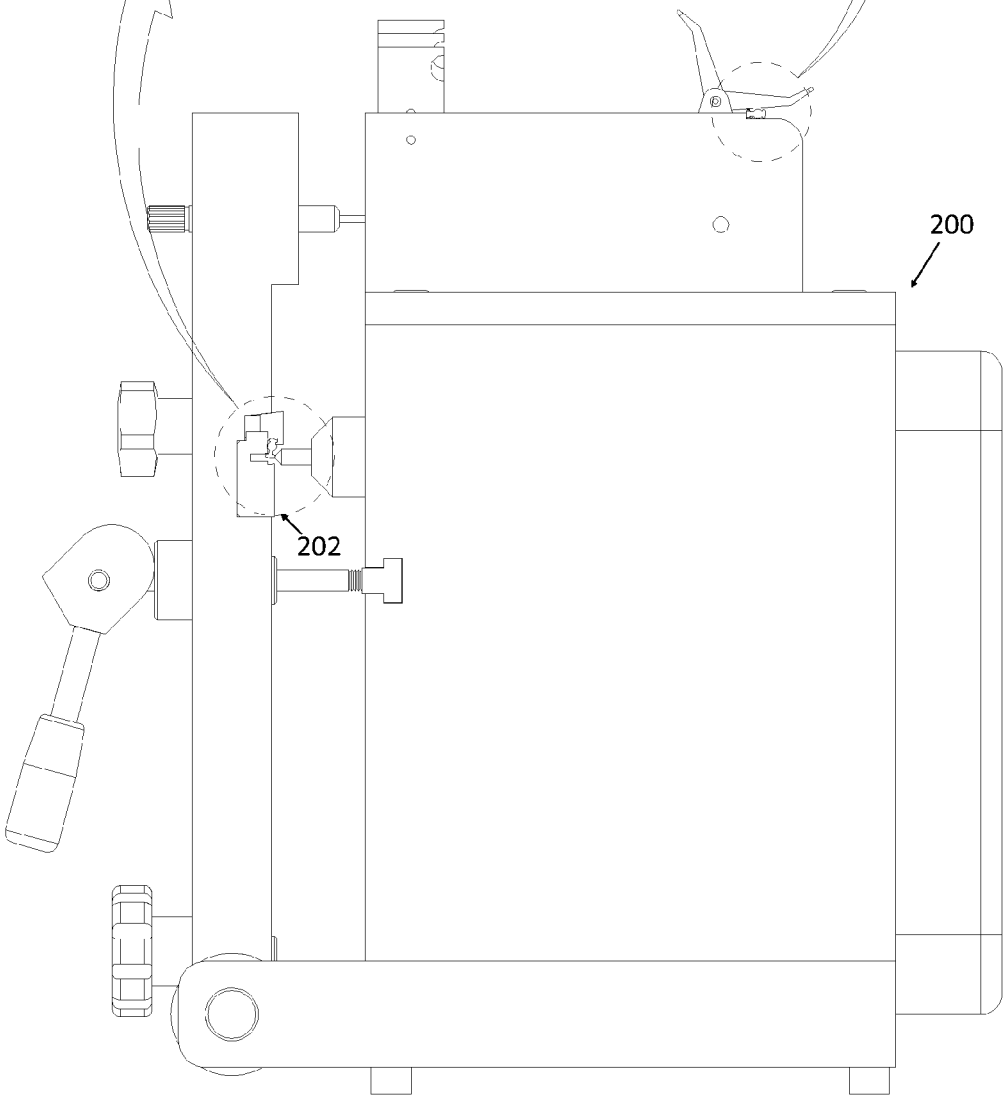
FIG. 68 is a simplified side-view illustration of the key cutting machine of FIG. 66.

Reference is now made to FIG. 70. It is clearly seen that if key 80 were mounted on key cut code reading device 180 of the prior art, no duplication of key 80 is possible. This is because it is impossible for the key cut code reading device 180 of the prior art to read the key cutting code of key 80 of the present invention; device 180 has no provision for sensing these key cuts. Thus, duplication of key 180 of the present invention is restricted to the key cutting machine 200 of the present invention. The key cutting code of the present invention can be recorded on a recording medium, such as but not limited to, an electronic chip or card.

It is also appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. An article for use with a cylinder lock comprising:

a cylinder lock body comprising at least two shells, each of said shells comprising a partial cylindrical wall that extends less than 360° about a longitudinal axis, said shells being affixed to each other with fasteners so that said partial cylindrical walls form a complete cylindrical wall that extends 360° about the longitudinal axis, and wherein each of said partial cylindrical walls is formed with a partially circumferential groove, and each of said partially circumferential grooves extends from an open end, located at a top of the cylindrical wall on which the partially circumferential groove is formed, circumferentially downwards to a closed end, and for each said closed end, a first axial notch extends axially from the closed end in a first direction and a second axial notch extends axially from the closed end in a second direction opposite to the first direction; and a plug rotatably mounted in said complete cylindrical wall of said cylinder lock body and comprising a plurality of chambers, separated by walls, wherein plug locking elements are disposed in said chambers, wherein at least one of said fasteners comprises a double resilient clasp comprising two clasps, each of said clasps having two opposite ends and each of said ends being formed with two outwardly extending tabs that extend axially with respect to the longitudinal axis, and wherein said double resilient clasp closes openings for said plug locking elements, and wherein said tabs are received in said axial notches.

2. The article according to claim 1, further comprising a side bar, said plug being formed with a recess for receiving therein said side bar, and wherein side bar receiving grooves are formed on an outer contour of each of said plug locking elements for receiving therein said side bar, and wherein for a given one of said plug locking elements, said grooves present on said given plug locking element are separated from one another by a portion of said given plug locking element, and peripheral trap notches are formed on said portion that separates said grooves, and said side bar comprises elongate ridges that can get caught in said trap notches upon application of a cylinder lock-picking torque to said plug.

3. The article according to claim 1, wherein for each of said partial cylindrical walls, said partially circumferential groove is formed at a central portion of said partial cylindrical wall.

* * * * *